US009392914B2

(12) United States Patent
Barringer

(10) Patent No.: US 9,392,914 B2
(45) Date of Patent: Jul. 19, 2016

(54) METHODS FOR UTILITY/SPORT TOWEL VARIANTS AND ADDITIONS

(71) Applicant: Todd James Barringer, Mill Creek, WA (US)

(72) Inventor: Todd James Barringer, Mill Creek, WA (US)

( * ) Notice: Subject to any disclaimer, the term of this patent is extended or adjusted under 35 U.S.C. 154(b) by 28 days.

(21) Appl. No.: 13/900,800

(22) Filed: May 23, 2013

(65) Prior Publication Data

US 2013/0323457 A1 Dec. 5, 2013

Related U.S. Application Data

(60) Provisional application No. 61/650,915, filed on May 23, 2012.

(51) Int. Cl.
*A47K 10/02* (2006.01)
*B65D 23/06* (2006.01)

(52) U.S. Cl.
CPC ..... *A47K 10/02* (2013.01); *B65D 23/065* (2013.01); *Y10T 29/49826* (2015.01); *Y10T 428/24008* (2015.01); *Y10T 428/24273* (2015.01); *Y10T 428/24298* (2015.01); *Y10T 428/24314* (2015.01)

(58) Field of Classification Search
None
See application file for complete search history.

(56) References Cited

U.S. PATENT DOCUMENTS

| | | | | |
|---|---|---|---|---|
| 2,154,772 | A * | 4/1939 | Rathemacher | A47G 11/001 215/392 |
| 6,065,177 | A | 5/2000 | Chien | |
| 6,643,870 | B2 | 11/2003 | Bertrand | |
| 6,901,615 | B1 * | 6/2005 | Lombardo et al. | 5/417 |
| 6,955,272 | B2 | 10/2005 | Collins | |
| 7,004,507 | B2 | 2/2006 | Shulman | |
| 7,600,473 | B2 | 10/2009 | Sheppard, Jr. | |
| 8,132,683 | B2 | 3/2012 | Rund et al. | |
| 8,307,489 | B1 | 11/2012 | Adame | |
| 2004/0231084 | A1 * | 11/2004 | McKenzie | 15/208 |
| 2007/0226934 | A1 * | 10/2007 | Bohannon et al. | 15/209.1 |
| 2012/0210531 | A1 * | 8/2012 | Kuk | 15/210.1 |

* cited by examiner

*Primary Examiner* — David Sample
*Assistant Examiner* — Donald M Flores, Jr.
(74) *Attorney, Agent, or Firm* — Lowe Graham Jones PLLC

(57) ABSTRACT

An utility/sport towel variants and additions for creating a sports or utility towel that can be placed or hung out of the reach of any contaminants, in any environment, until needed. The utility/sport towel variants and additions generally includes the towel material, the various hooks, holes for bottle styles and placement, magnets for hanging, various fold indicators and making it easier to grip the bottle with towel on bottle.

30 Claims, 43 Drawing Sheets

METHODS FOR UTILITY/SPORT TOWEL VARIANTS AND ADDITIONS

PRIORITY CLAIM

This application claims the benefit if U.S. Provisional Application Ser. No. 61/650,915 filed May 23, 2012 and entitled CLEAN WATER ABSORBENT MATERIAL IN ANY ENVIRONMENT, which is hereby incorporated herein by reference in their entirety for all purposes.

FIELD OF THE INVENTION

The present invention relates generally to utility and sports towel systems and more specifically it relates to an utility/sport towel variants and additions for creating a sports or utility towel that can be placed or hung out of the reach of any contaminants, in any environment, until needed.

SUMMARY OF THE INVENTION

The invention generally relates to an utility and sports towel system which includes the towel material, the various hooks, holes for bottle styles and placement, magnets for hanging, various fold indicators and making it easier to grip the bottle with towel on bottle.

In some embodiments, an apparatus includes a sheet of absorbent material. The sheet defines a plurality of apertures and the apertures are positioned within the sheet such that when the sheet is folded such that the apertures are aligned, an extent of the folded sheet outward from the apertures is less than an extent of the sheet when unfolded. In some embodiments, at least one of the apertures is defined by a hanger secured to a corner of the sheet. In others, the apertures, when aligned, are offset from a center of the folded sheet.

In some embodiments, the sheet is foldable according to a folding pattern having equally sized panels, each panel having an aperture of the plurality of apertures positioned substantially at a center thereof. In some embodiments, one or more fold indicators are formed on the sheet, the fold indicators corresponding to the folding pattern. For example, the fold indicators may include stitching in the sheet.

In some embodiments, a plurality of gripping elements are secured around at least one of the apertures of the plurality of apertures. In another, the sheet defines at least one slit sized to receive a user's hand.

In some embodiments, the sheet includes first and second outer layers and an inner layer, the outer layers being more effective to wick moisture than the inner layer. In some embodiments, the sheet has non-uniform composition across an extent thereof.

In some embodiments, the plurality of apertures define a lock. For example, in some embodiments, the plurality of apertures each define an opening having a primary diameter portion and a lobe protruding from the primary diameter portion. When the towel is twisted such that the lobes are not aligned, removal of the towel from a bottle is hindered.

In some embodiments, an apparatus includes a bottle and a sheet of absorbent material, the sheet of absorbent material defining a plurality of apertures sized to receive a neck of the bottle. The sheet may be folded having the neck of the bottle extending through the plurality of apertures such that no portion of the folded sheet drapes to a lower surface of the bottle, such as when the bottle is placed with the lower surface resting on a surface with the neck pointing upward.

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an utility/sport towel variants and additions for creating a sports or utility towel that can be placed or hung out of the reach of any contaminants, in any environment, until needed.

Another object is to provide an Utility/sport Towel Variants And Additions that allow the towel or handy wipe to remain out of the contaminants reach until needed.

Another object is to provide an Utility/sport Towel Variants And Additions that include variant means of hanging the towel or handy wipe.

Another object is to provide an Utility/sport Towel Variants And Additions that works with a hydration system to keep the towel or handy wipe off potentially contaminated surfaces.

Another object is to provide an Utility/sport Towel Variants And Additions that can be used as a promotional tool by beverage bottlers, athletic apparel companies, sports equipment manufactures to name a few.

Another object is to provide an Utility/sport Towel Variants And Additions that provides a product tailored to specific sports or tasks.

Another object is to provide an Utility/sport Towel Variants And Additions that is a disposable variant made of nonwoven materials and has diaper like qualities.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application

BRIEF DESCRIPTION OF THE DRAWINGS

Preferred and alternative examples of the present invention are described in detail below with reference to the following drawings:

FIG. 1 shows a towel constructed from terry cloth but nonwoven and other materials can be used. The idea is that when a corner towel is in essence clipped off you can use the area to add or create new and innovative features.

In this example an elastic cord is imbedded into the towel and only fixed to the towel by the ends of the cord. The final product is a loop at the cut corner that can be stretched much larger than it appears possible. The cord stretches in and out of the pocket created by the towel.

Figure 1:
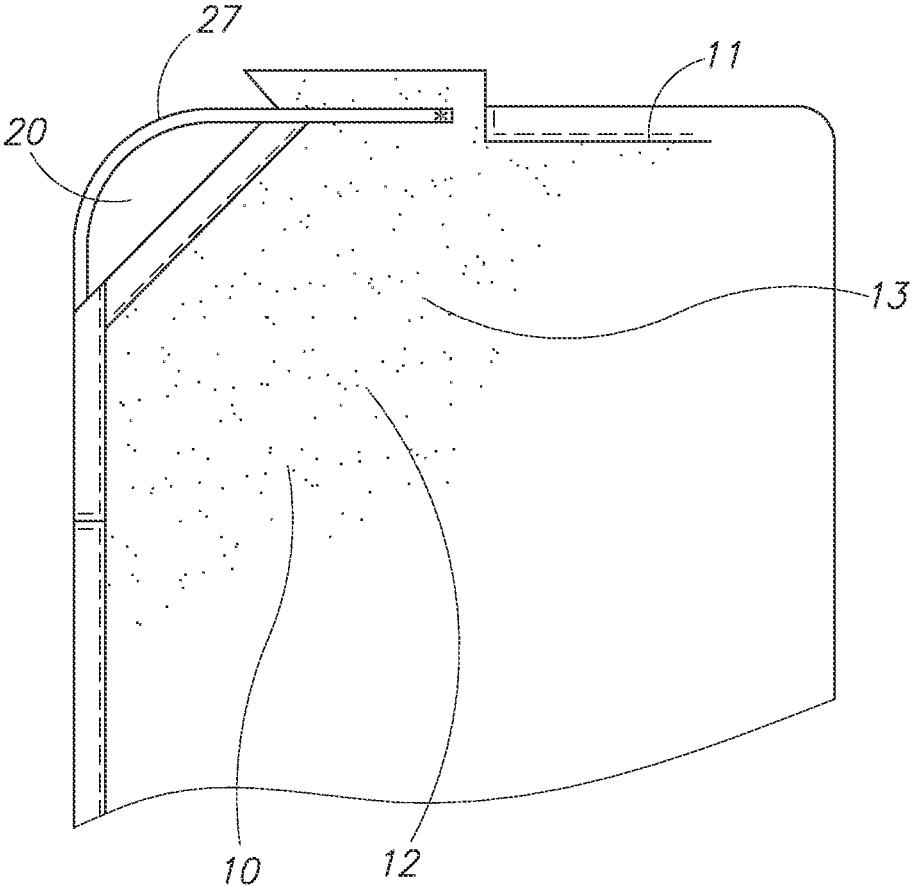
FIG. 1 is a top view of the present invention.
Figure 2:
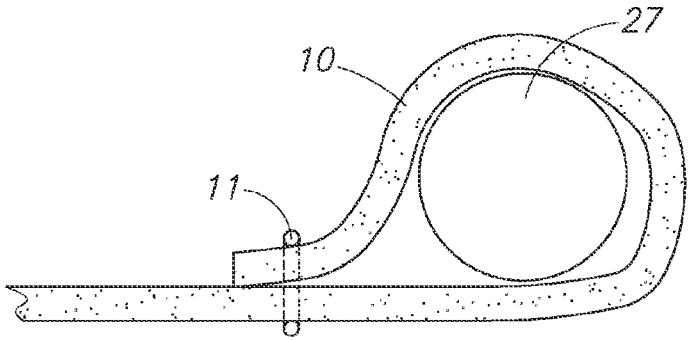

FIG. 2 is an end view of the present invention. FIG. 2 is an exploded end view of FIG. 1's cord and towel connection area. It shows how the towel material wraps around the cord but leaves it room to expand and contract as the cord stretched. The cord would need to be stretched when you wanted to put the loop around a larger object.

Figure 3:
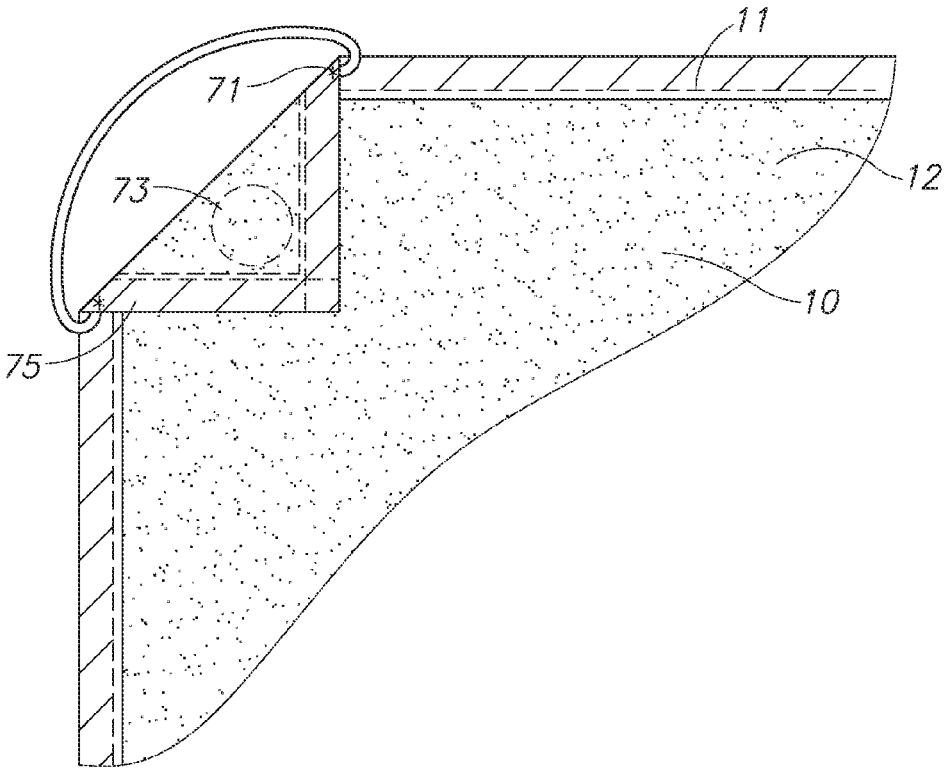

FIG. 3 is a top view of the present invention. FIG. 3 shows another variant of the cut corner towel by folding the corner over you get a similar look while also creating a place to simply incorporating a magnet.

Figure 4:
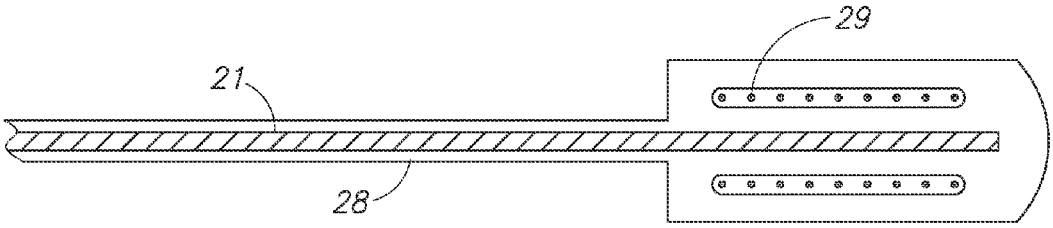

FIG. 4 is a top view of the present invention. FIG. 4 shows an exploded view of a flexible wire 21 incased in rubber 28 with a rubber flange 29. The flange is for sewing or attaching to a towel, garment or something else. If the other end of the wire has a flange, they can both be attached to a single garment to create a loop for hang or attaching things to. The grooves shown in the flange with the dots in are where the flange would be stitched. The grooves allow the stitching to be recessed below the surface of the flange.

Figure 5:
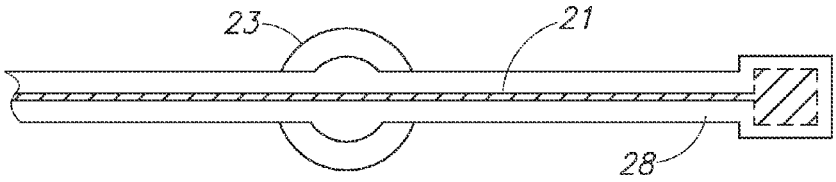

FIG. 5 is a top view of the present invention. FIG. 5 shows a exploded top view of a similar device as to that in FIG. 4. The device in FIG. 5 also has a suction cup 23 incorporated into the wires rubber outing casing if the device was attached to a towel, for example, the suction cup could be used to hang the towel from a smooth surface like a mirror, window, kitchen appliance or door.

Figure 6:
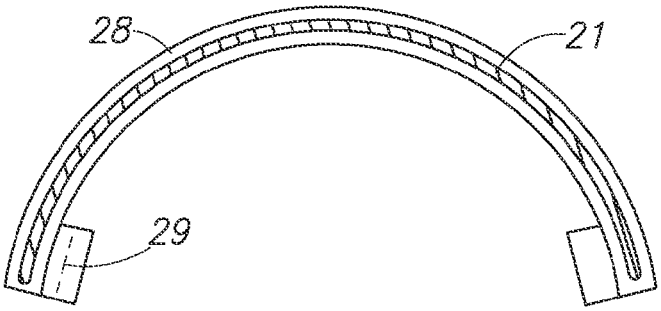

FIG. 6 is a top view of the present invention. FIG. 6 shows a top view of a variant of the device mentioned in the FIGS. 4 and 5 descriptions. In this case showing the flanges 29 at both ends of the rubber incased flexible wire.

Figure 7:
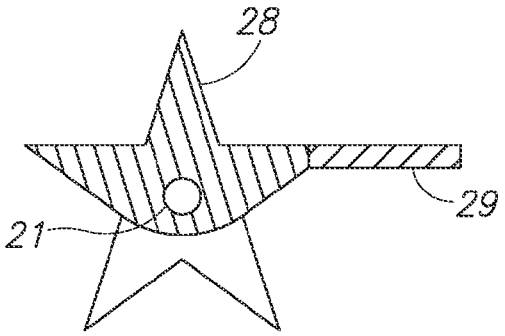

FIG. 7 is an end view of the present invention. FIG. 7 shows an end view of the flexible wire 21 incased in a "star" patterned rubber casing 28 with the attachment flange 29 protruding out the star for gives more aggressive gripping abilities when in use and hanging from an object.

Figure 8:
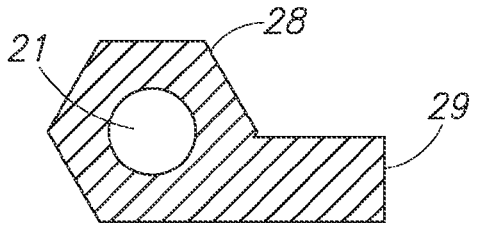

FIG. 8 is an end view of the present invention. FIG. 8 shows an end view of another variant of the rubber casing 28 around the flexible wire 21. This variant is going to have a little less gripping ability than the star shape shown in image 7 but last longer in its original form or show less wear with the same amount of use. Its shape would also reduce the rock of a garment once hung.

Figure 9:
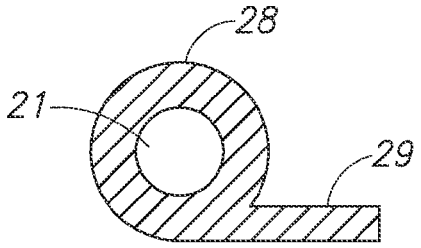

FIG. 9 is an end view of the present invention. FIG. 9 shows an end view of yet another variant of the rubber casing 28 around the flexible wire 21. The gripping ability of this variant is primarily going to be a result of the rubber material. Dependent upon the wire coating, this variant could have a long life of use and potentially more "tangle free".

Figure 10:
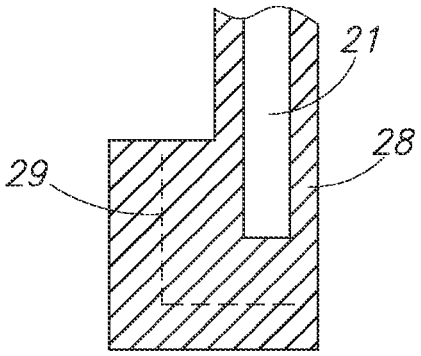

FIG. 10 is a top view of the present invention. FIG. 10 is a exploded view top view of the flanged end of the coated flexible wire. This is one variant that has flange material both along the side of the wire as well as at the end of the wire that is capable of being secured to a garment or object.

Figure 11:
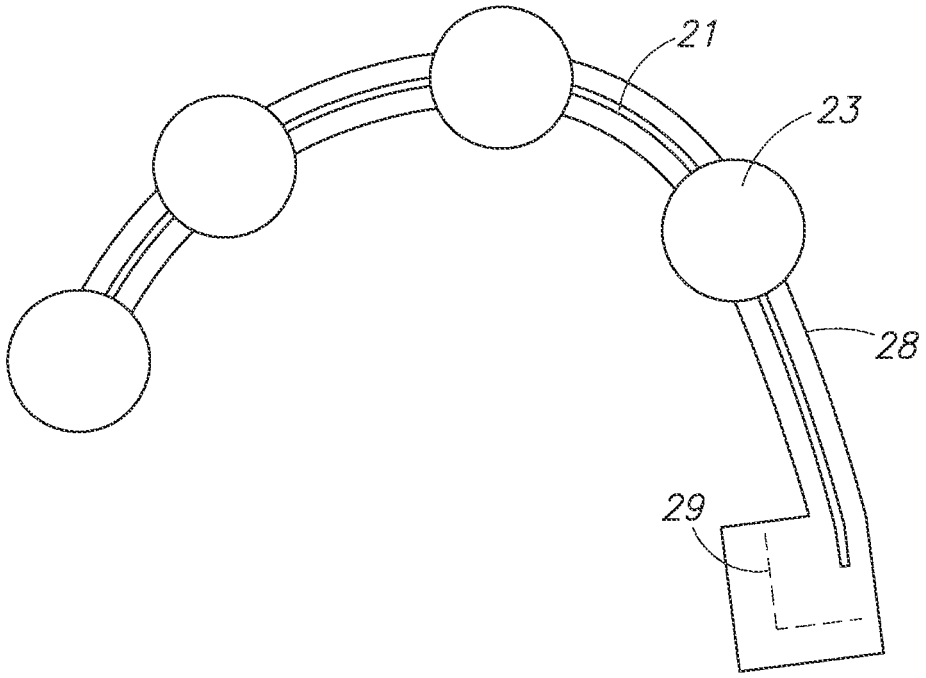

FIG. 11 is a bottom view of the present invention. FIG. 11 shows a bottom view of a attachable, flexible, hanging wire with coating 28 and flange 29 and incorporated suctions cups 23. Once it's permanently attached to an object by the one end the extending arm can be used like to wrap around objects or be bent in the form of a hook to hang or the suction cup can be used.

Figure 12:
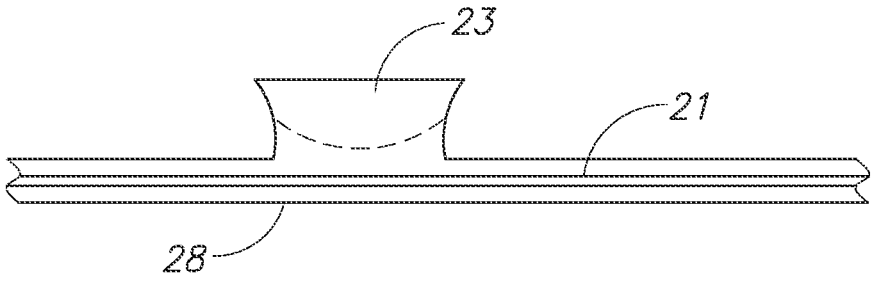

FIG. 12 is a side view of the present invention of how the suction cup 23 is incorporated into the flexible wire 21 coating 28.

Figure 13:
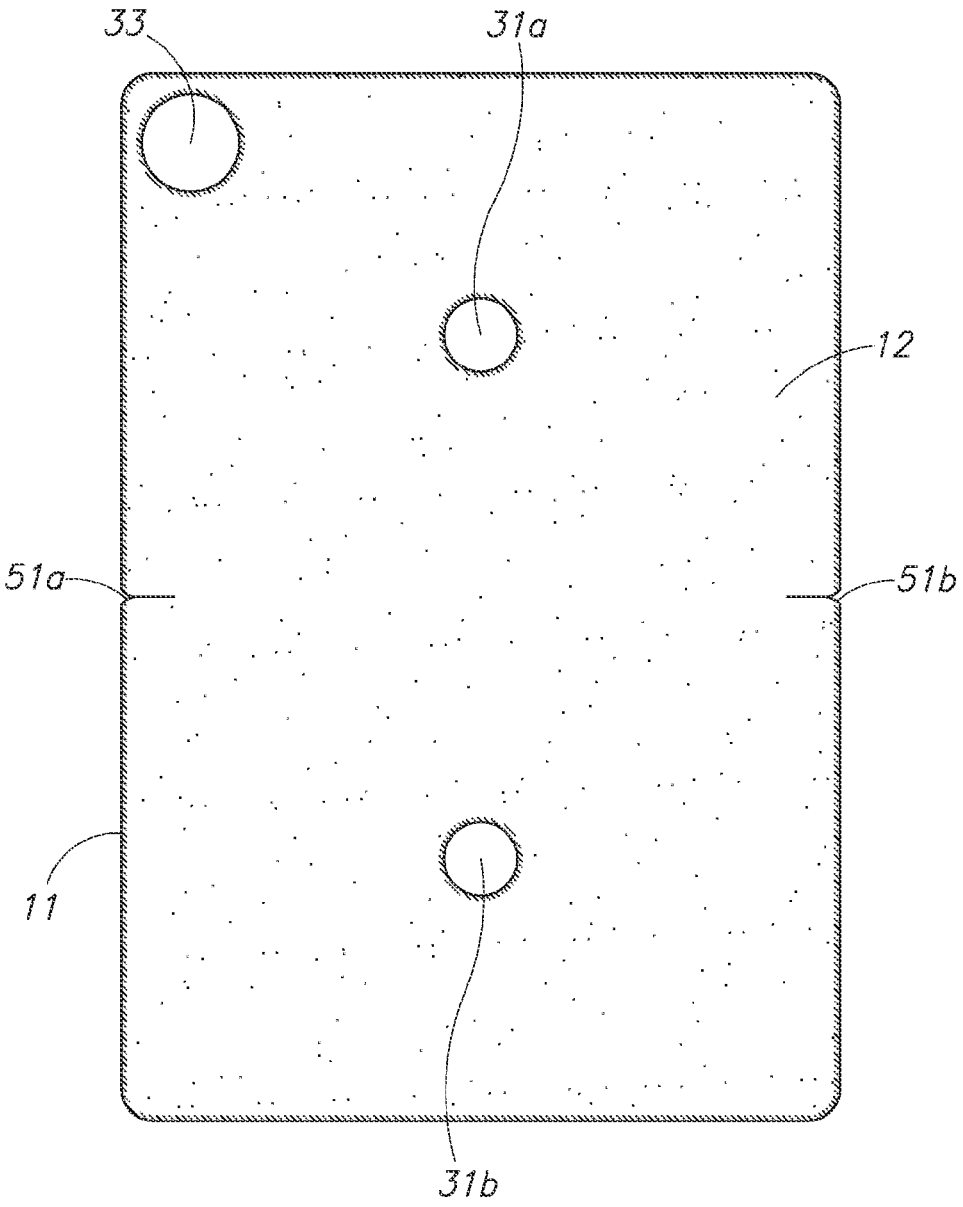

FIG. 13 is a top view of the present invention. FIG. 13 shows a top view of sports towel variant. In this image it is constructed out of micro fiber terry cloth. It has one hole for hanging 33, circular in this variant. This variant has two holes for the bottle 31*a* and 31*b*. When the towel is folded in half the two holes lineup allowing a bottle to partially pass through. These holes can be shaped for one specific bottle or can be designed to accommodate multiple sizes and shapes. The fold indicators 51*a* and 51*b* are markers that indicate at where the towel needs to be folded in order for the hold to lineup. In this image the indicator are a pinch and stitch in nature. They give the towel a natural tendency to fold in a certain way because the towel material in this image is of a woven material the perimeters of the towel and anywhere it's been cut needs to be hemmed with stitching 11 to prevent it from fraying.

Figure 14:
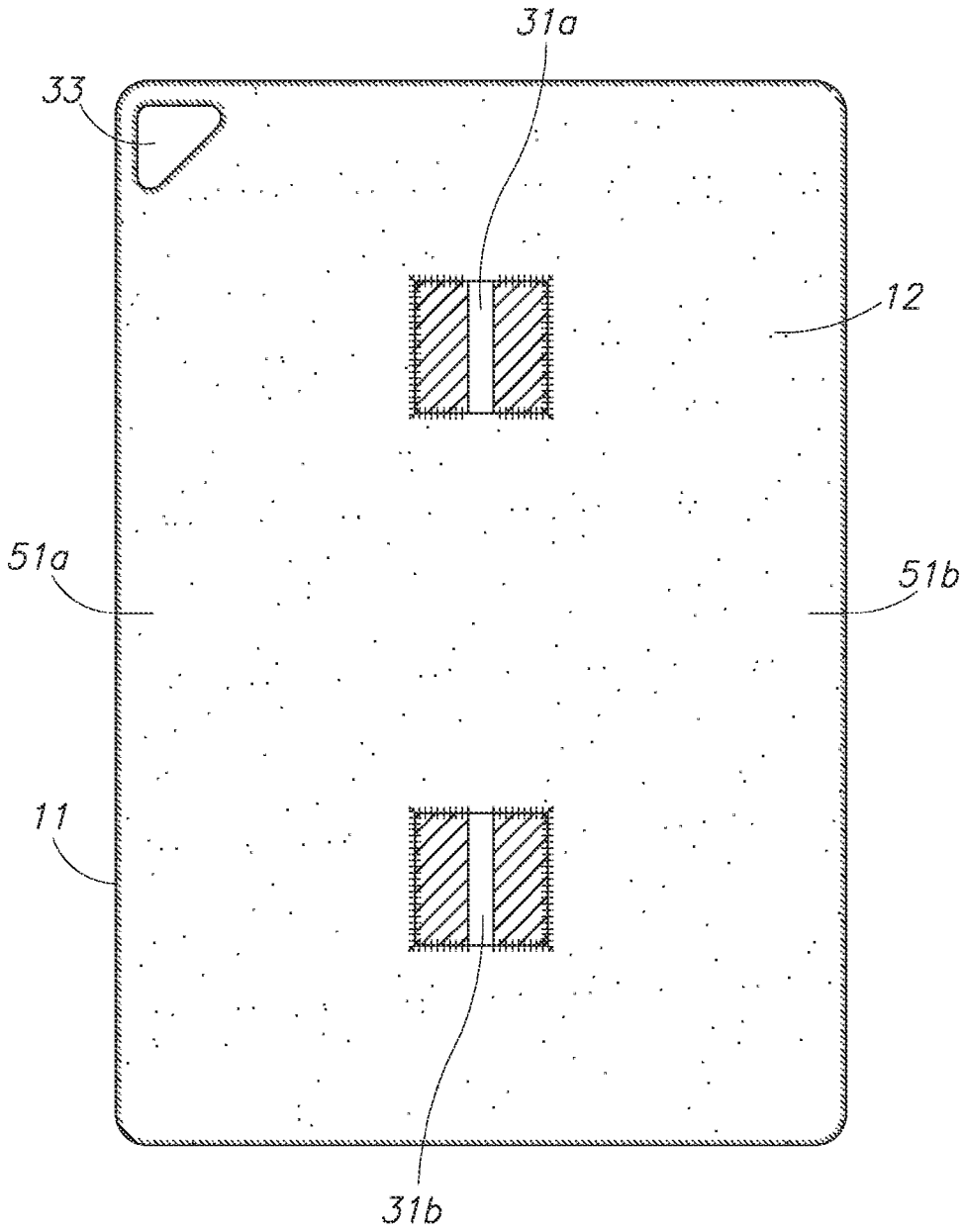

FIG. 14 is a top view of the present invention. FIG. 14 is a top view of a sports towel variant. My comments are very similar to that of image 13 except that the hole for hanging 33 and the holes for a bottle 31*a* and 31*b*. The hole for hanging is shaped differently. It leaves a equal amount of material at the perimeter corner of the towel for attaching id cards, key rings or hand sanitizers. The holes for show a different style as well. They began as square holes but by inlaying a different material (red) it creates a rectangle hole opening. The red material can either be of a less/more water absorbent material or something more elastic.

Figure 15:
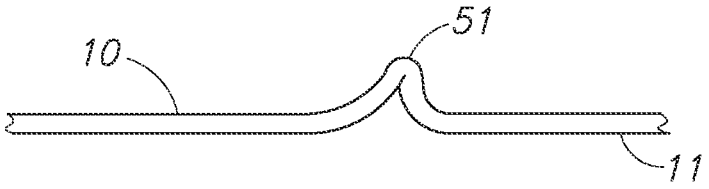

FIG. 15 is an exploded side view of the present invention. FIG. 15 shows an exploded side view of a fold indicator 51. It is a permanently pinched along the edge to the towel material 10. This is just one way of indicating where the towel needs to be folded to get the holes for bottle to lineup.

Figure 16:
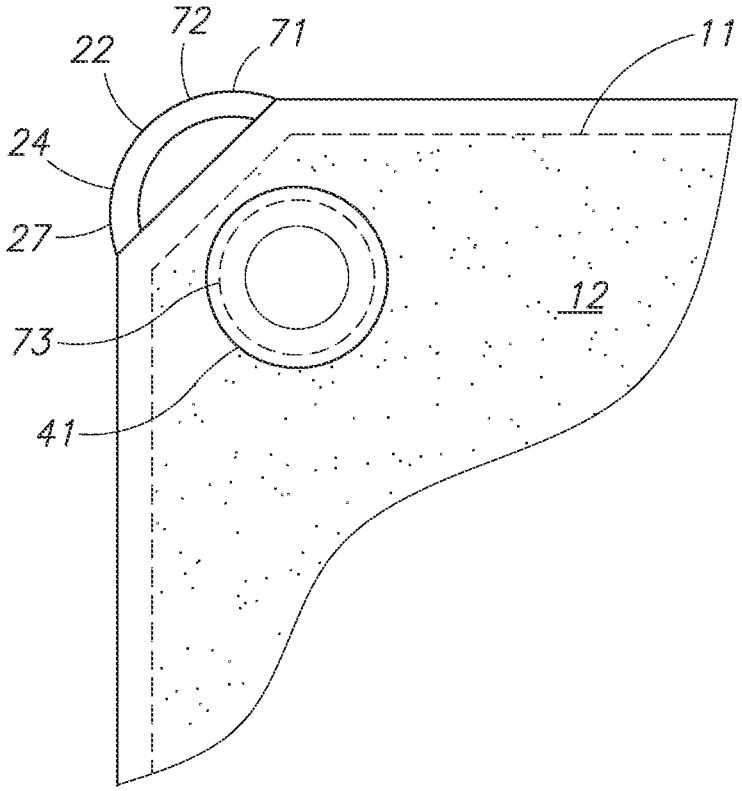

FIG. 16 is an exploded top view of the present invention. FIG. 16 shows a exploded top view of an athletic towel embodiment. This version has the cut corner with in attached magnet 41 and material to act as a hook 22, 24, 27, 72 and 71. In various embodiments that include a nonwoven material, in contrast to a micro fiber, in FIG. 16, the magnet could be placed between the layers of material during manufacturing.

Figure 17:
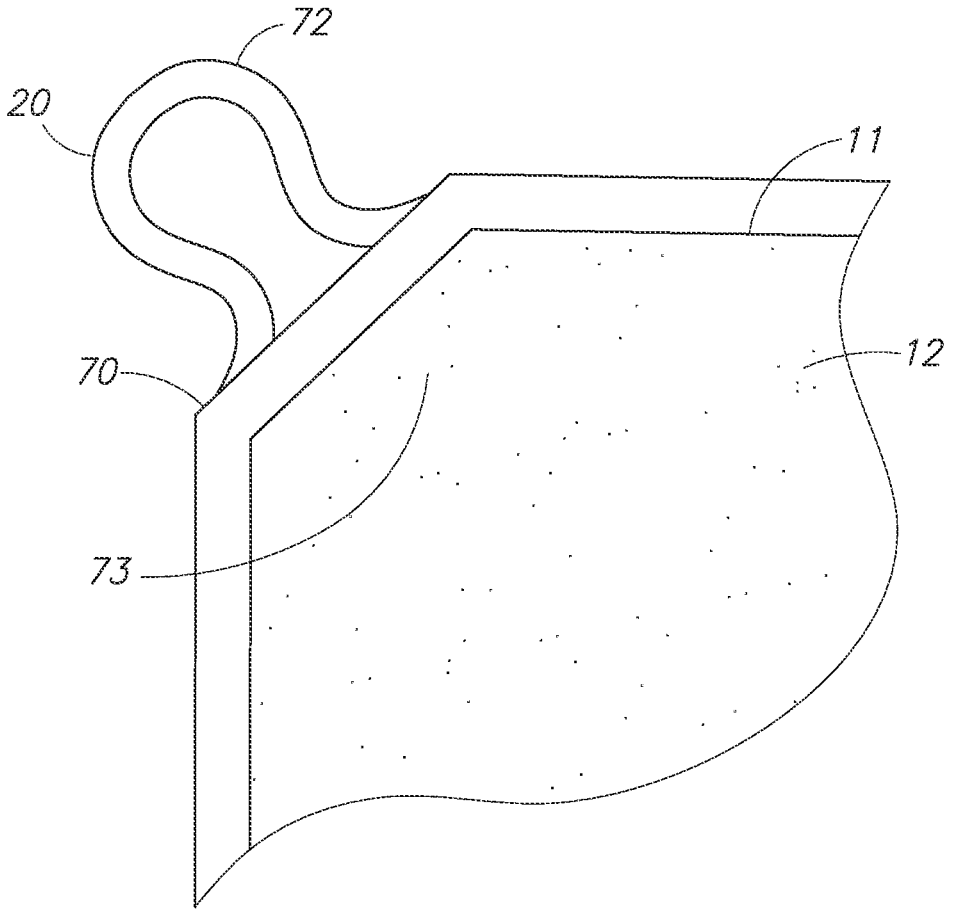

FIG. 17 is an exploded top view of the present invention. FIG. 17 is an exploded top view of the cut corner area of the towel. It shows how corporate logos can be incorporated into the towel in a utilitarian manure. In this example, FIG. 17 is in the form of Lululemon Athletica logo. It can be made of elastic stretch cord, rubber coated wire, or parachute cord for example.

Figure 18:
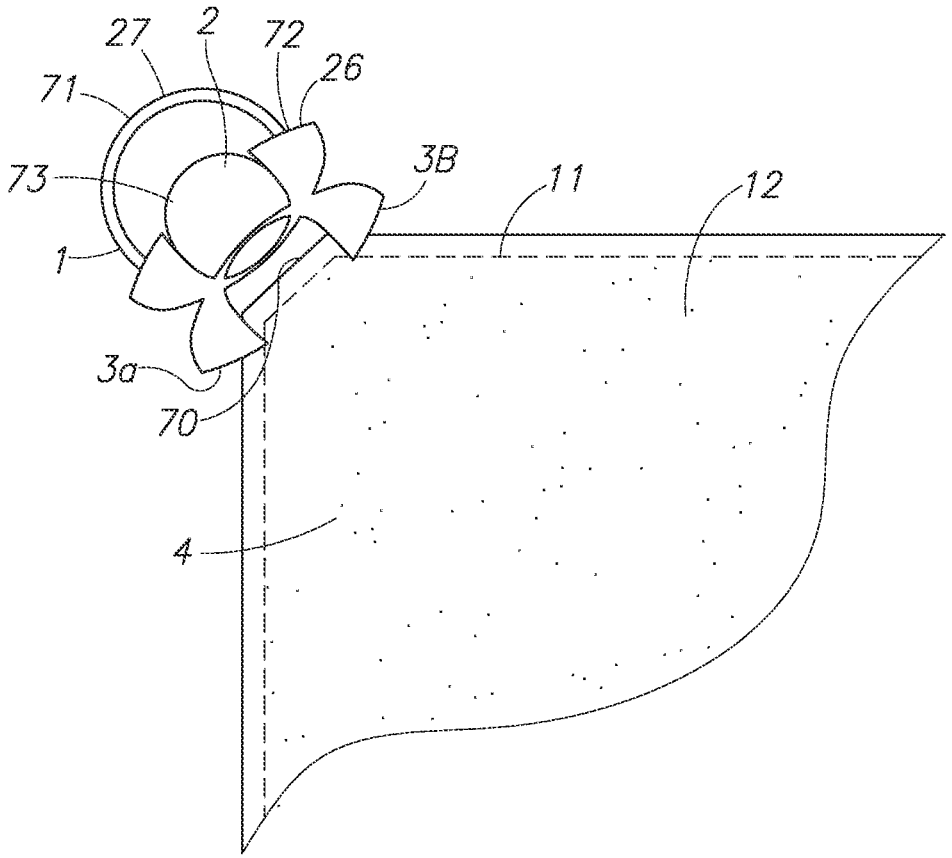

FIG. 18 is an exploded top view of the present invention. FIG. 18 is a top view of the cut corner area of the towel. In this case, an Under Armor logo is incorporated. Included features are a magnet 73 and a rope for hanging the towel 71.

Figure 19:
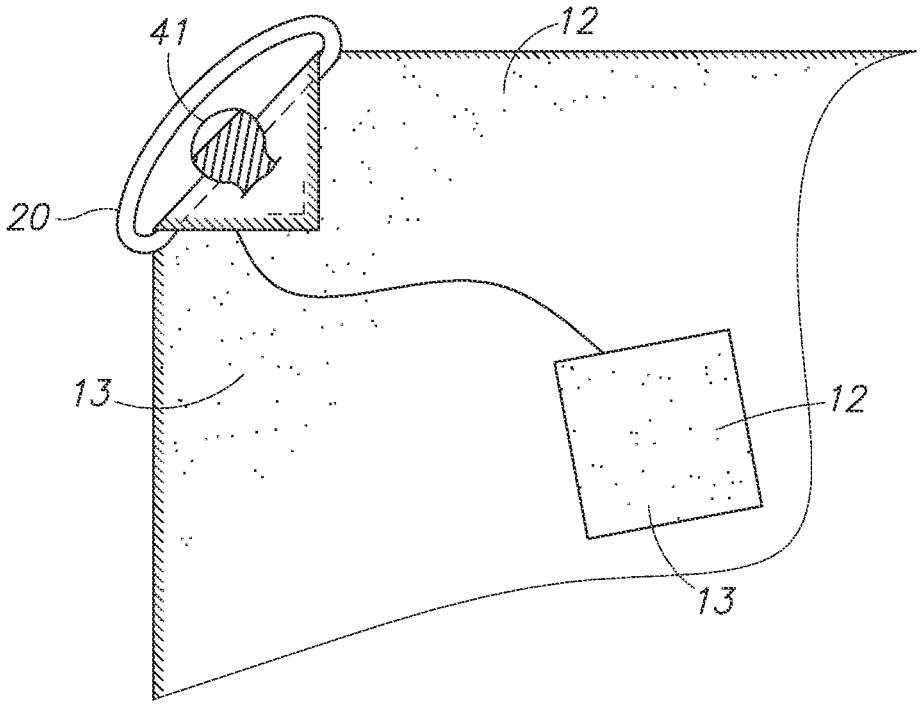

FIG. 19 is an exploded top view of the present invention. FIG. 19 show the cut corner area of an athletic towel. The area where some of the towel hanging characteristics lie in. For example the cut corner is wrapped with another piece of material 20 to allow a simple way of incorporating a cord for hanging 20 and a magnet for hanging 41. This alternative was created as a result of manufacturing capabilities when building a prototype. Please note that 20 will be a separate image and will be detailed as such.

Figure 20:
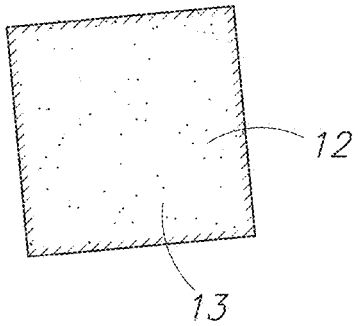

FIG. 20 is a top view of the present invention. FIG. 20 shows a top view of a square piece of material. The square piece if material may wrap a cut corner of the sports towel so that it will cover cords for hanging or magnet. It doesn't have to be square. This little piece of technology is highly flexible and invites creativity.

Figure 21:
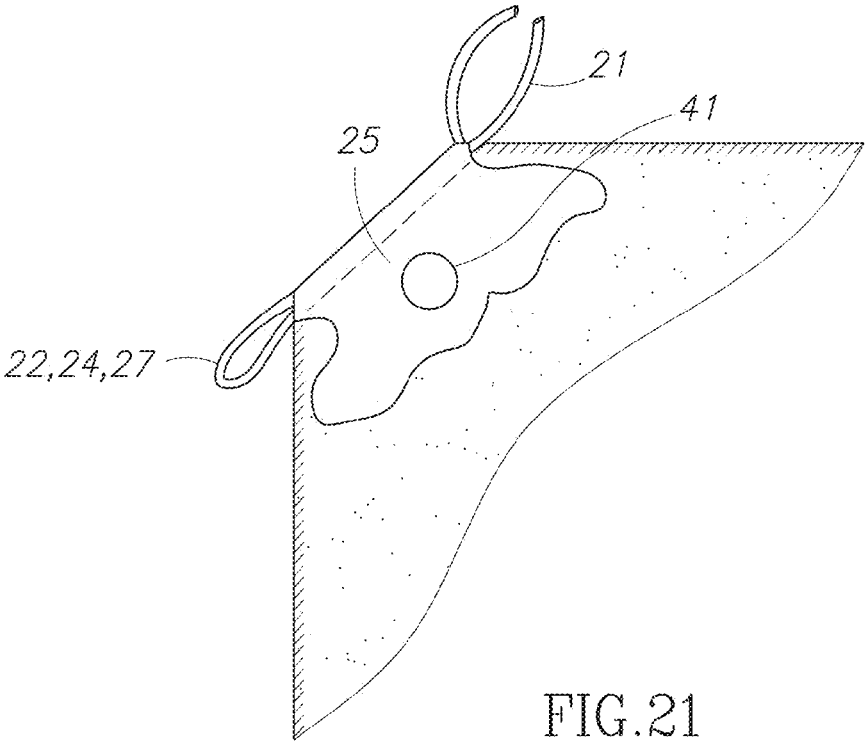

FIG. 21 is an exploded top view of the present invention. FIG. 21 shows a close up of the cut corner are of the towel. This product was created using the technology described in FIG. 20. Rather than using a square patch to imbed other technology the image of a butterfly was used. A magnet was used for the wings spots 41. The antennas are made of rubber coated flexible wires 21. The tail could be constructed of rubber coated wire 22 or imbedded rope 24 or imbedded elastic cord 27.

Figure 22:
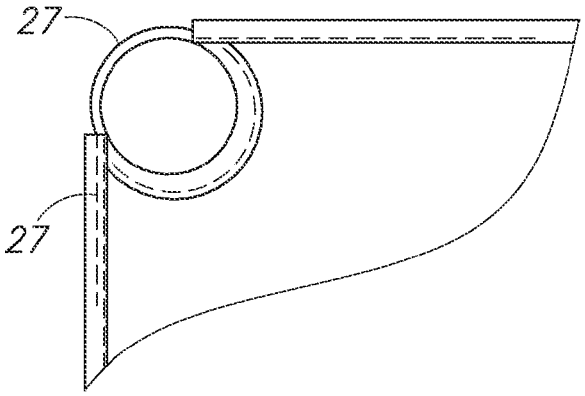

FIG. 22 is an exploded top view of the present invention. FIG. 22 shows a close up of towels hook area. In this example an imbedded elastic cord 27 has been incorporated into the towels unique design.

Figure 23:
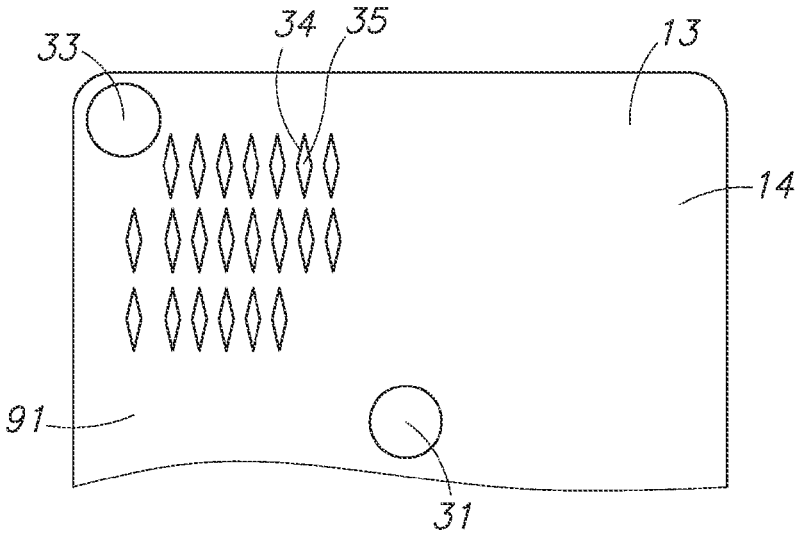

FIG. 23 is an exploded top view of the present invention. FIG. 23 is a top view of a upper half of a nonwoven material 13 towel. The towel shows a simple hole for hanging 33 in this case and one of the holes for bottle 31. This image of a laminated towel 14 shows one example of holes for wicking 34 and holes for contouring 35. Note that the holes for wicking and contouring have not been finished in this example. Most of the towels surface would be covered with holes when done. The red portion is the more absorbent layer which is sandwiched between to blue layers (characteristics undetermined at this point) 91.

Figure 24:
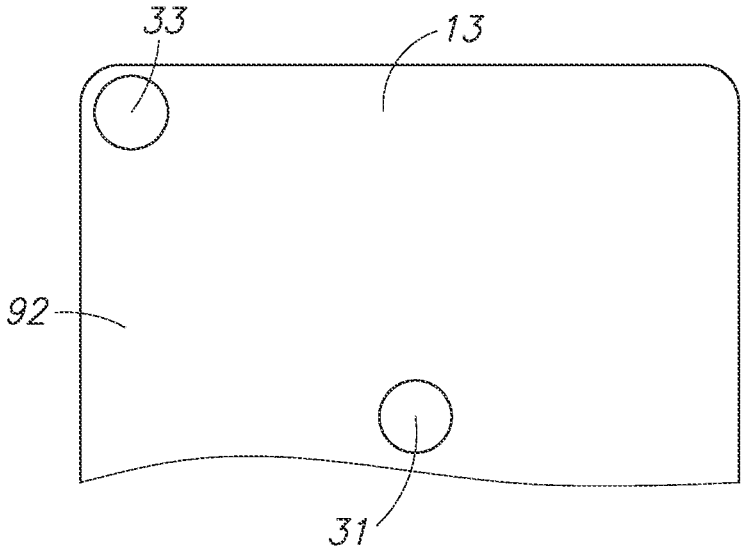

FIG. 24 is an exploded top view of the present invention. FIG. 24 is a top view of a upper half of a nonwoven material 13 and sports towel 92. Because this is the middle layer of the image shown in FIG. 23 the perimeter dimension and the size and shape of the hanging hole 33, the holes for bottle 31 are exactly the same. However, it does not have any holes for wicking or contouring in this example.

Figure 25:
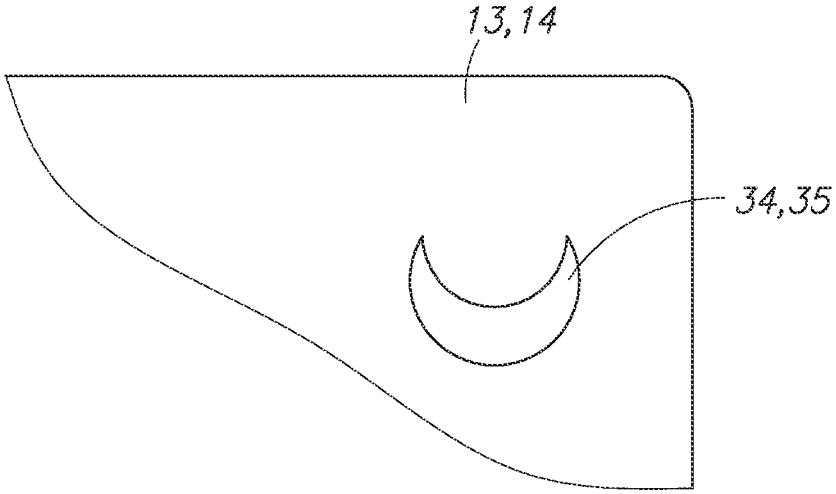

FIG. 25 is an exploded top view of the present invention. FIG. 25 is a close up and alternative design of the holes for wicking 34 and the holes for contouring 35.

Figure 26:
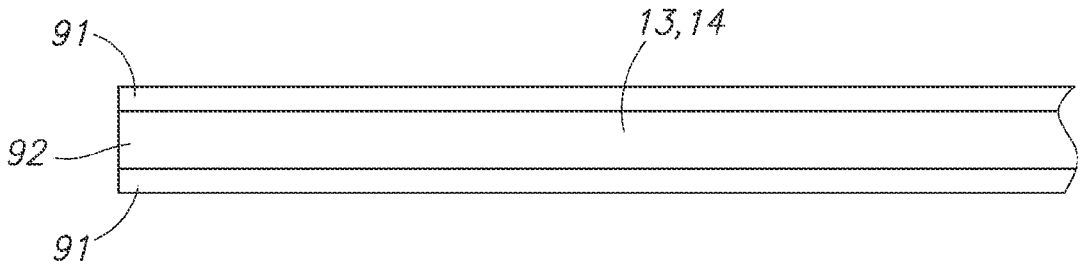

FIG. 26 is an exploded side view of the present invention. FIG. 26 is a close up side view of laminated nonwoven sports towel. It shows how the sports towel is constructed. The construction consists of 3 layers of nonwoven material 91, 92, 91. Both layers of 91 are of the same formula and layer 92 is of a different formula.

Figure 27:
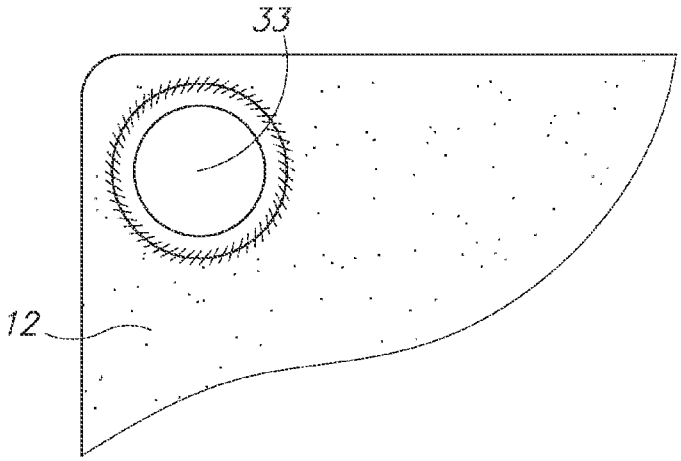

FIG. 27 is an exploded top view of the present invention. FIG. 27 is a close up of a micro fiber sports towel 13. What is different in this variant of the hole for hanging 33 is the elastic ring that is attached to the inside of the hole.

Figure 28:
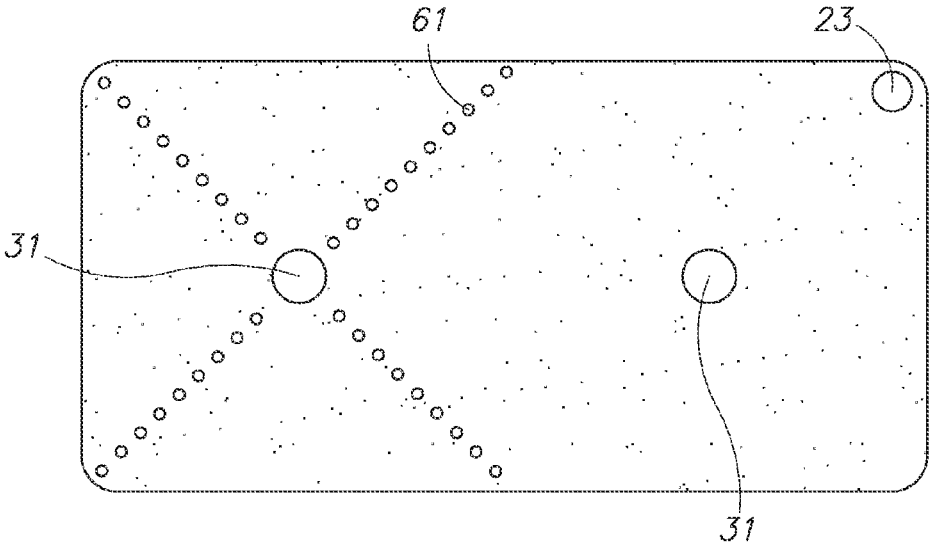

FIG. 28 is a bottom view of the present invention. FIG. 28 is a bottom view of a sports towel variant (this statement is a little misleading because one the towel is folded in half, half of the bottom becomes the top). This variant has rubber attached permanently to the towel 61 for the purpose of improving the grip of the towel to the bottle. In one of the corners of the towel is a suction cup 23. The suction cup is used to hang the towel from various objects.

Figure 29:
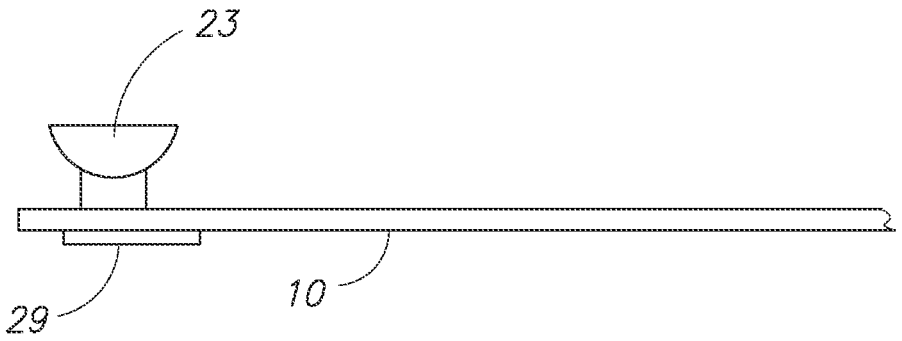

FIG. 29 is an exploded side view of the present invention. FIG. 29 is a close up side view of the suction cup 23 that is also in image FIG. 28. The way this suction cup is attached to the towel is through the use of a rubber flange 29. The flange is sewn or glued to the towel.

Figure 30:
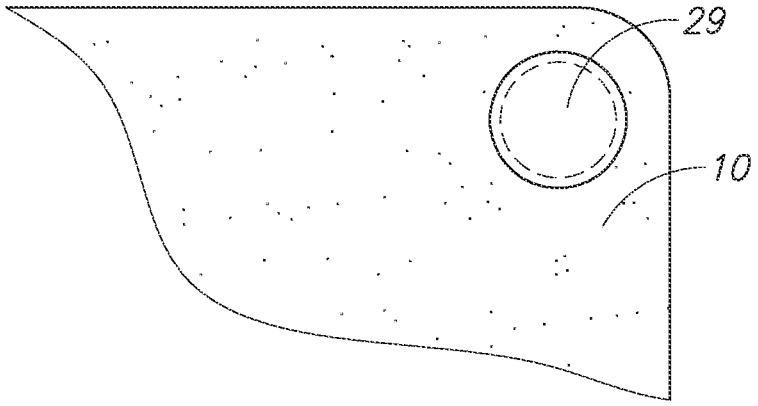

FIG. 30 is an exploded bottom view of the present invention. FIG. 30 is a close up of the back side of the suction cup detailed in FIGS. 28 and 29 is show the flange 29 stitched to the material 10.

Figure 31:
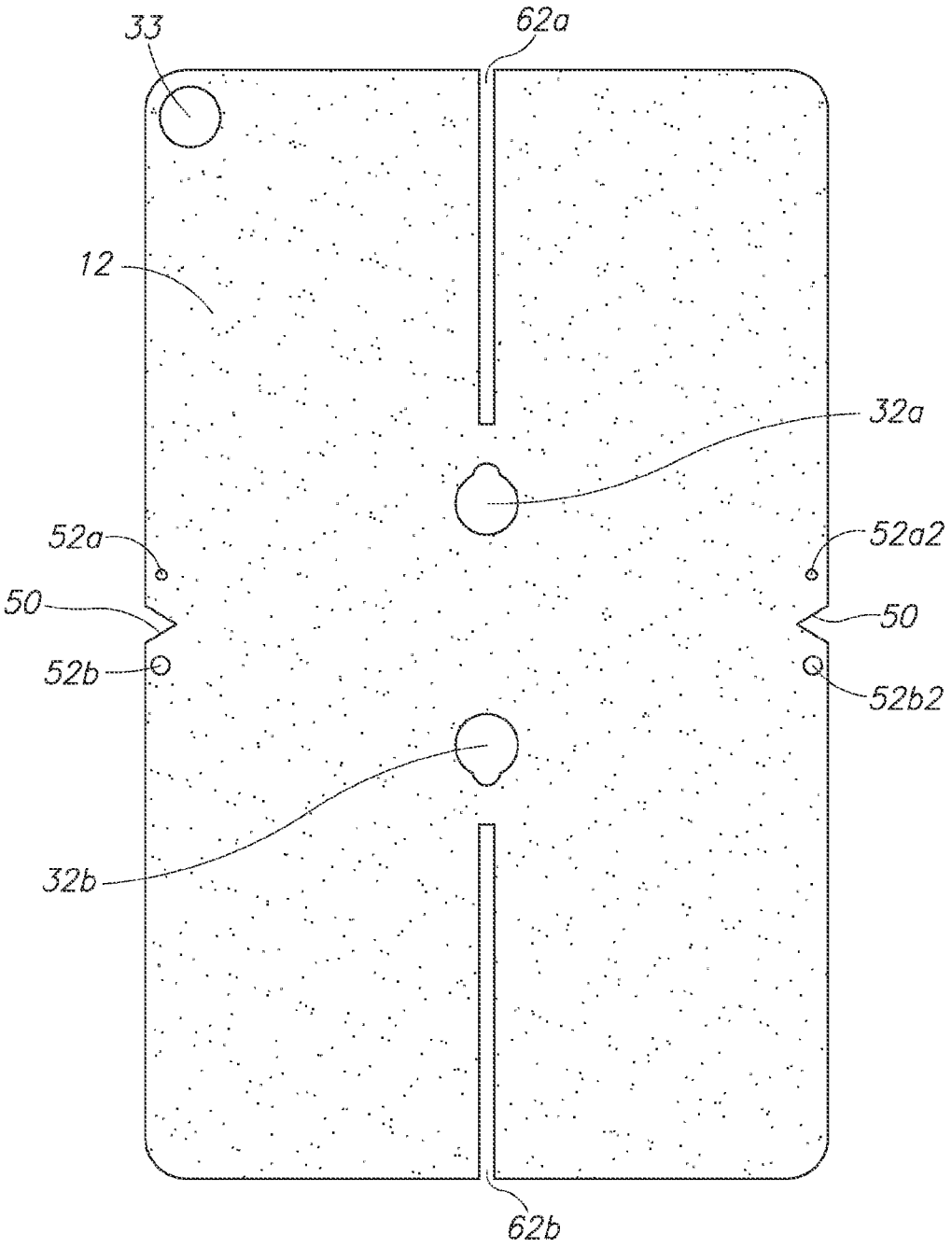

FIG. 31 is a top view of the present invention. FIG. 31 shows a sports towel 12 with several unique features. The augmentation of the towel 62*a* and 62*b* are to allow the towel to drape in such a way around the bottle that the bottle can grasped securely. The holes for bottle 32*a* and 32*b* have a unique notch that, with a twist, the towel can be locked to the bottle. One of the unique fold indicating systems on the towel are 52*a*, 52*b*, 52*b*2. These are raised surfaces you should be able to feel the dot 52*a* fit inside the circle 52*b*. When this is done to both sides of the towel you will know that you are folding it in the correct place to get the holes for bottle 32*a* and 32*b* to line up.

Figure 32:
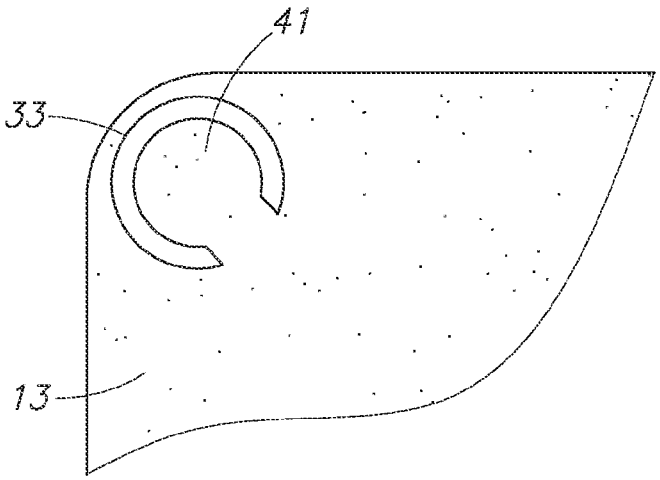

FIG. 32 is an exploded view of the present invention. FIG. 32 is a close up shot of the towels hook for hanging area. It shows how a flap of material 41 can be created within the hole for hanging 33 which could be used to attach a magnet or suction cup for example.

Figure 33:
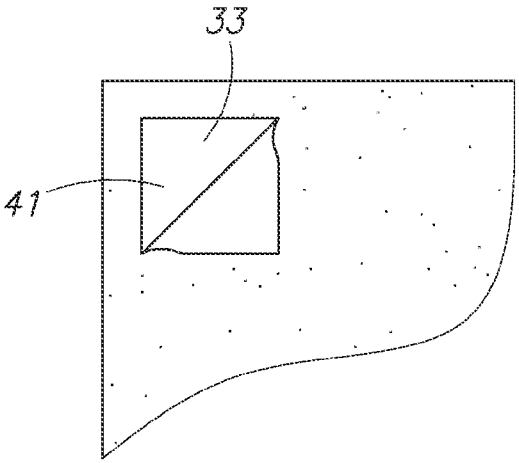

FIG. 33 is an exploded view of the present invention. FIG. 33 shows a close up shot of the towels hanging are, very similar in nature to that of image FIG. 32. The hole for hanging the towel 33 is the result of cutting the flap which upon a magnet could be attached. Note that 42 in this image shows where the flap came from.

Figure 34:
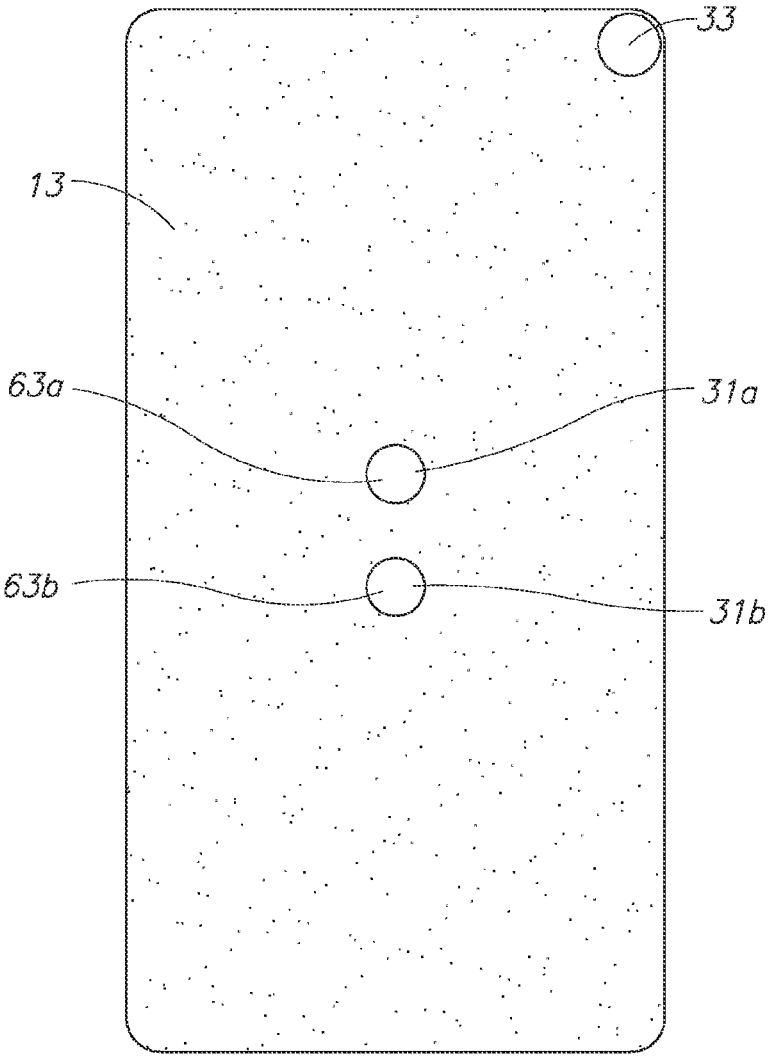

FIG. 34 is a top view of the present invention. FIG. 34 shows the entire surface of a sports towel made from nonwoven material 13. Notice that the holes for bottle 31*a*, 31*b*, 63*a* and 63*b* placed closer together. This will allow most of one side of the bottle to remain exposed when the towel is on it for better gripping of the bottle.

Figure 35:
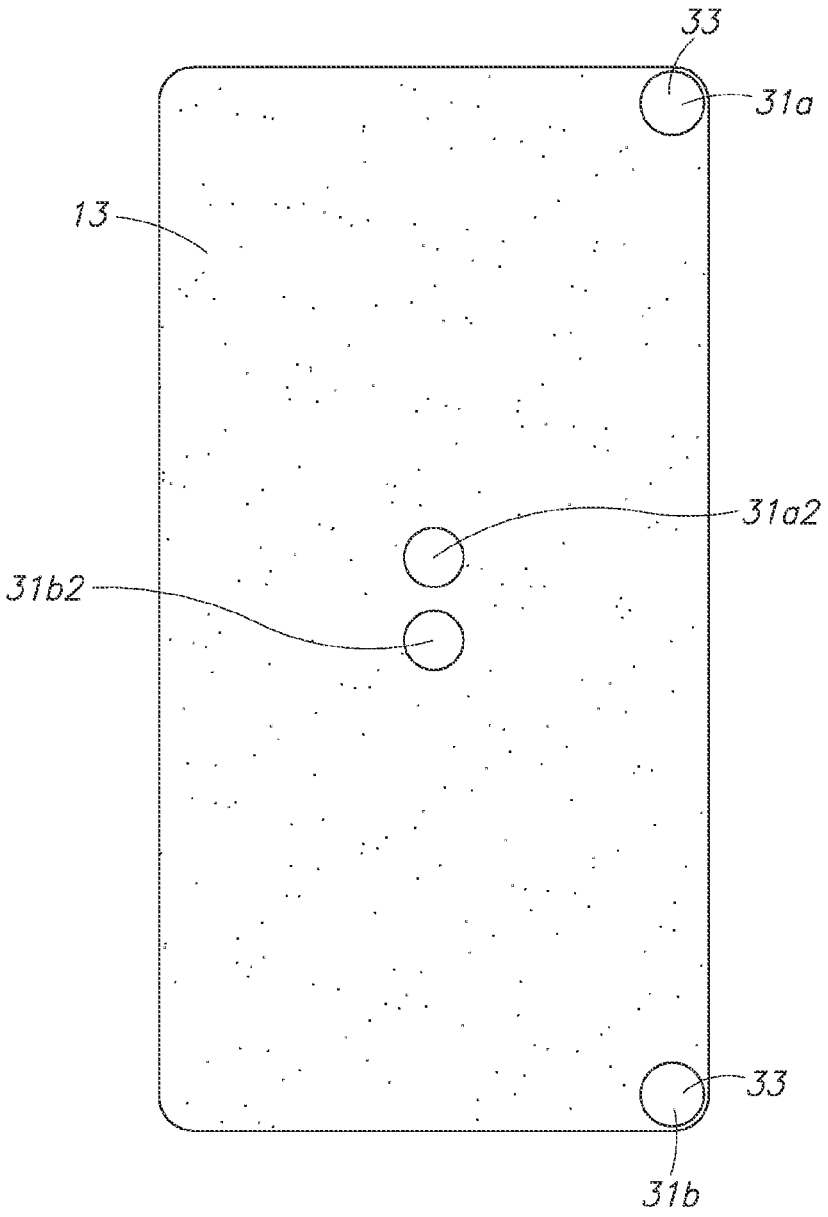

FIG. 35 is a top view of the present invention. FIG. 35 shows the entire surface of a sports towel made from nonwoven material 13. This image is very similar to that of image 34. The major difference is the inclusion of an additional hole for hanging FIGS. 31*a* and 31*b* which could be folded together and hung from a bottle or anything else that is low to the ground without allowing the towel to touch the ground.

Figure 36:
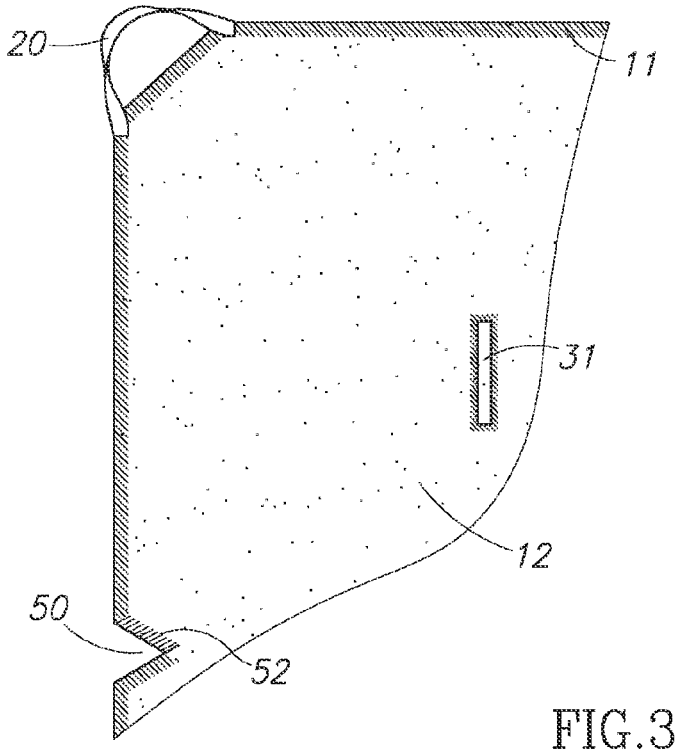

FIG. 36 is a top view of the present invention. FIG. 36 shows a top down view of a sports towel section. This particular towel has an imbedded ribbon as a hook 20 raised fold indicators 52 a slot hole 31 for a hole for bottle.

Figure 37:
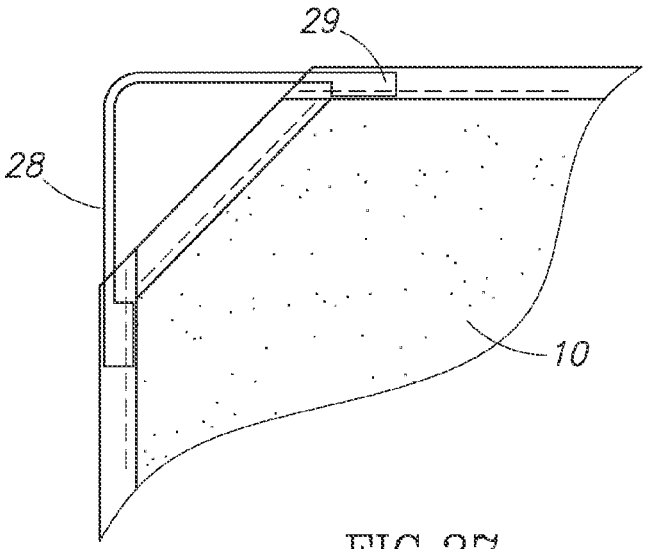

FIG. 37 is an exploded top view of the present invention. FIG. 37 shows a close up of the cut corner are of a sports towel and the integration of a rubber coated flexible wire 28 and its flange 29.

Figure 38:
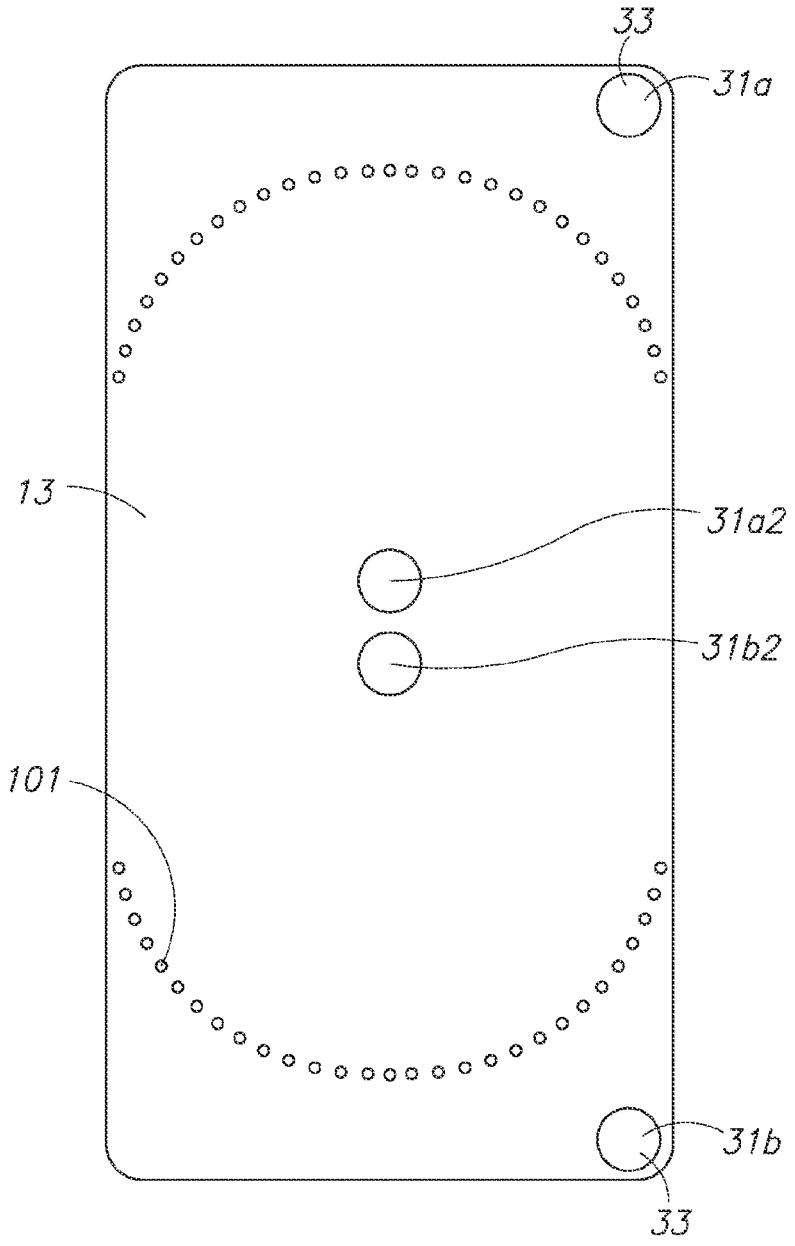

FIG. 38 is a top view of the present invention. FIG. 38 shows an entire sports towel made from nonwoven material. The difference between this image and image 35 is the addition of the perforation holes 101. The perforations in this example are designed so that a portion of the towel can be torn off to better fit a shorter bottle. Notice the curved nature. This to allow a consistent distance between the bottom of the towel and the floors surface even as the towel rocks back and forth on the bottle.

Figure 39:
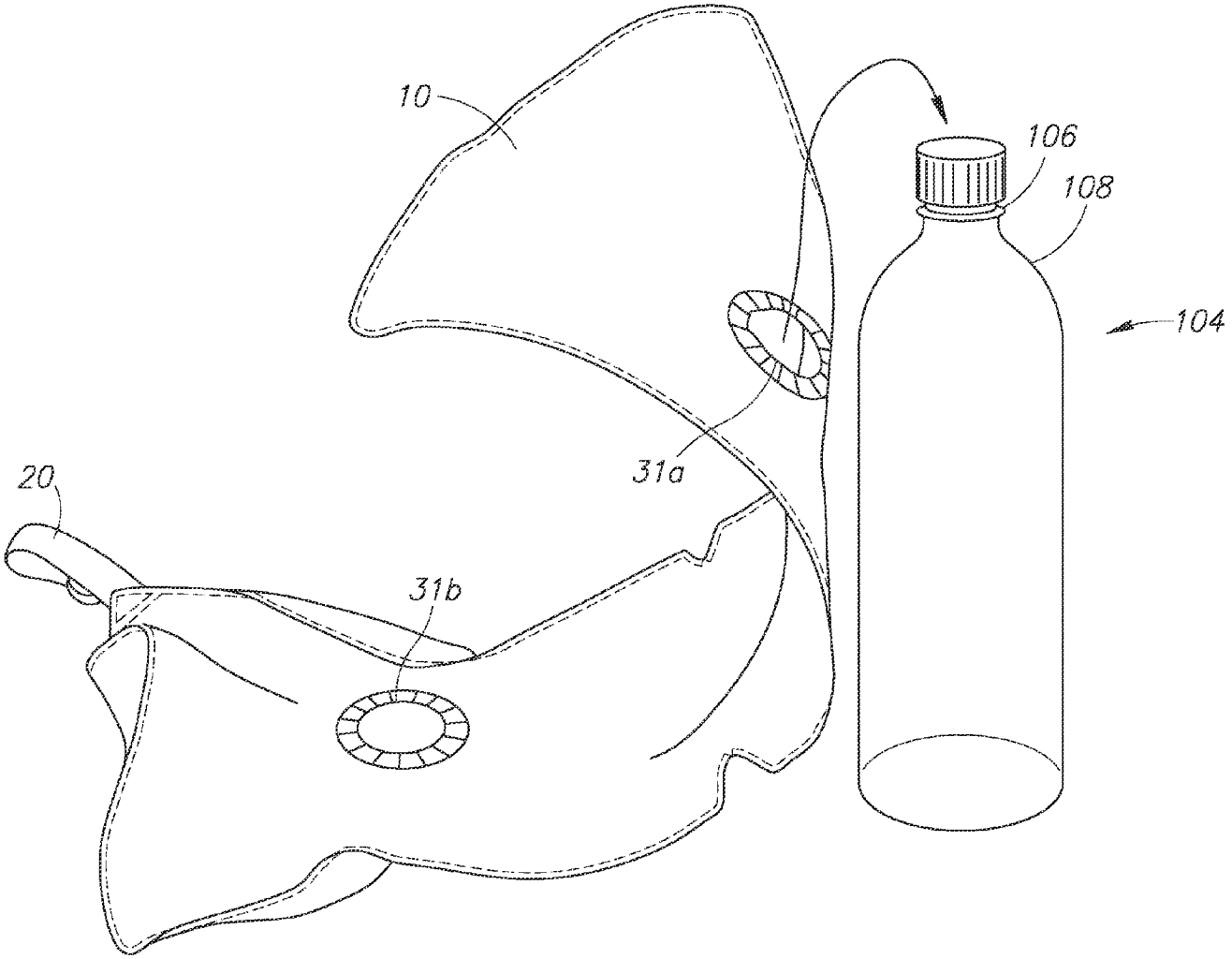

FIG. 39 is an isometric view of a sports towel and bottle illustrating a method of operation of the sports towel in accordance with an embodiment of the invention.

Figure 40:
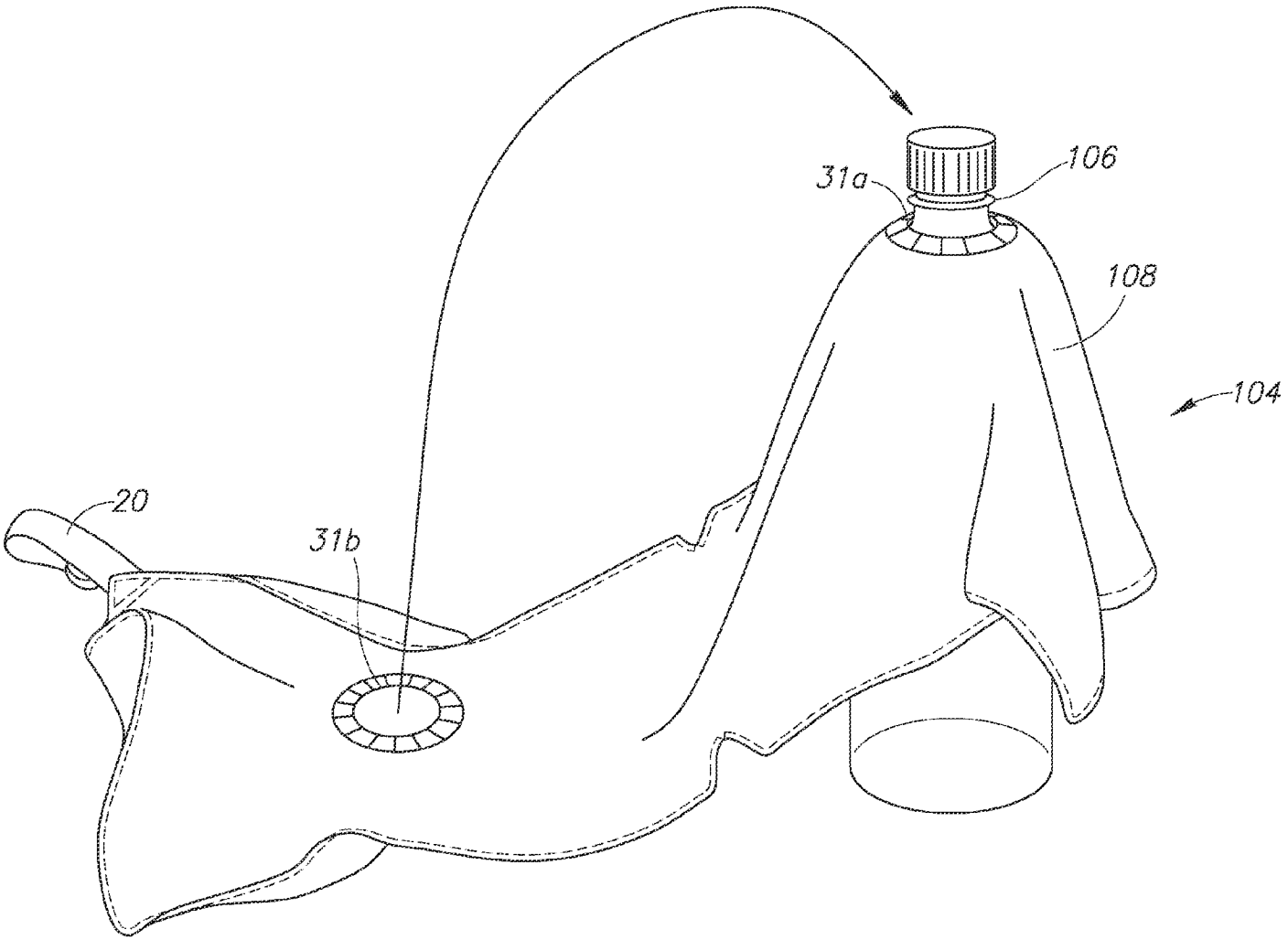

FIG. 40 is an isometric view of a sports towel and bottle having the sports towel partially engaged with the bottle in accordance with an embodiment of the invention.

Figure 41:
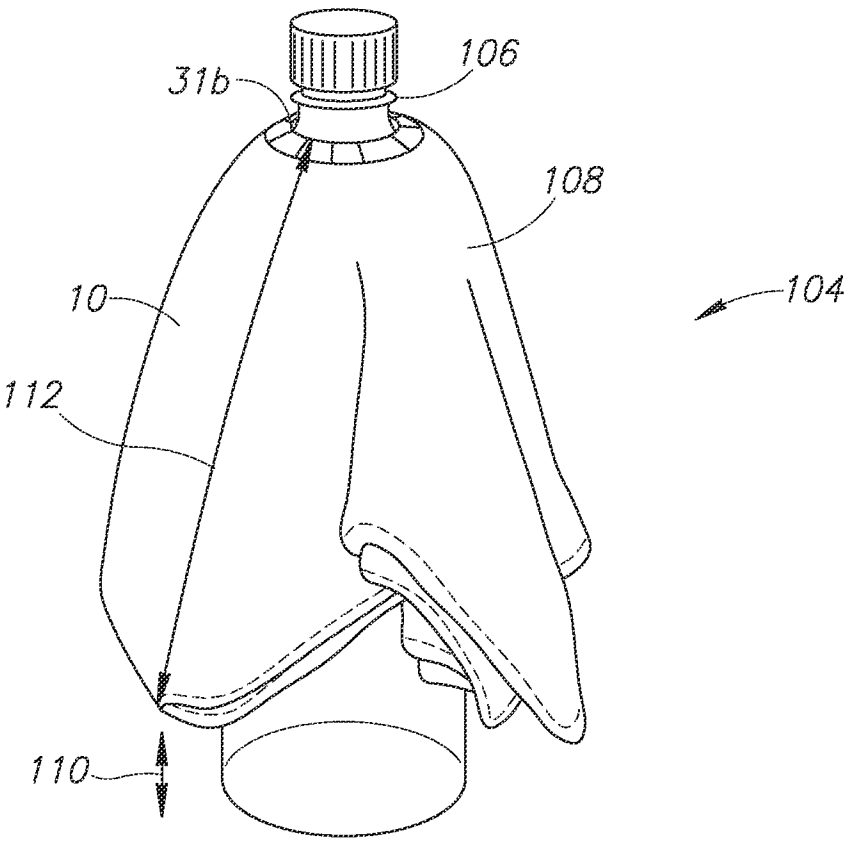

FIG. 41 is an isometric view of a sports towel in complete engagement with the bottle in accordance with an embodiment of the invention.

Figure 42:
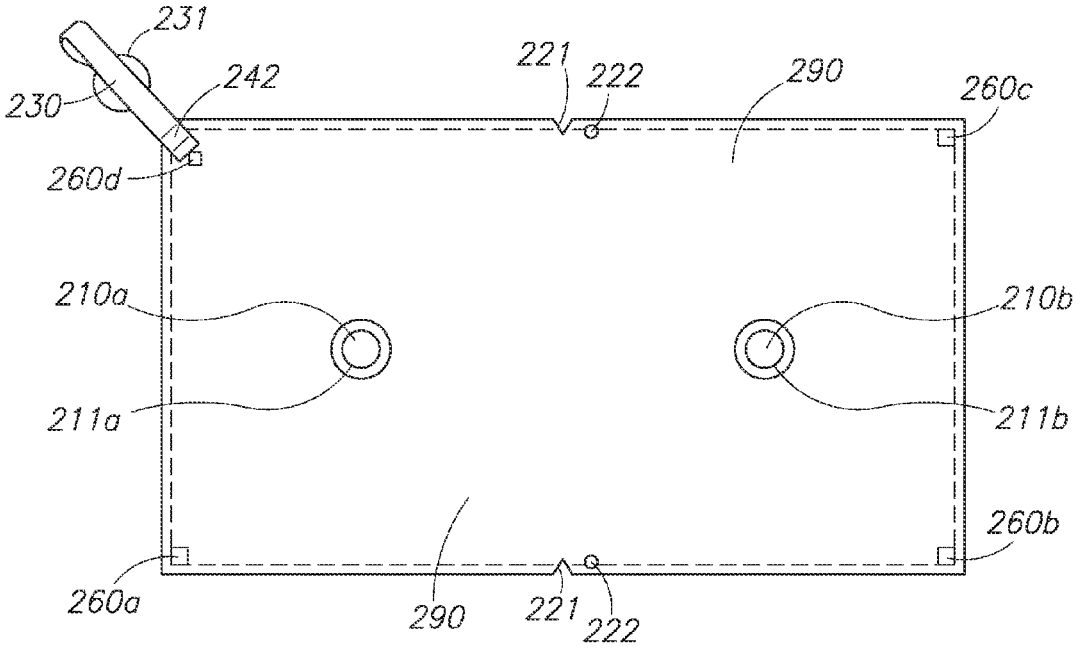

FIG. 42 is a top view of the present invention. FIG. 42 is a top view of the entire Towel laid out flat.

Figure 43:
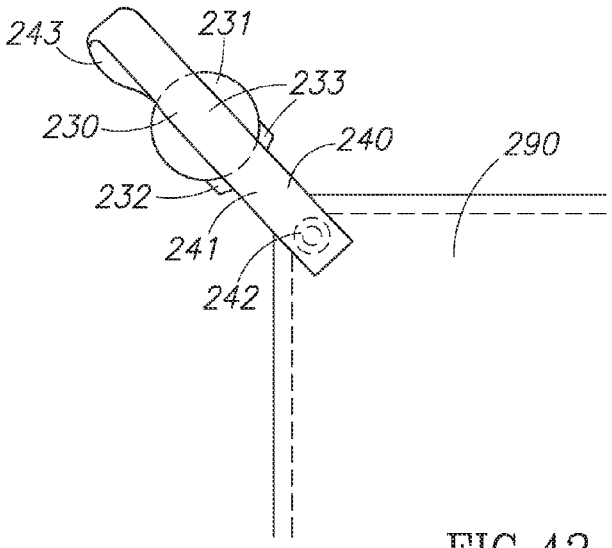

FIG. 43 is an exploded top view of the present invention. FIG. 43 shows an exploded top view of the Towels Tether in relation to the Towel.

Figure 44:
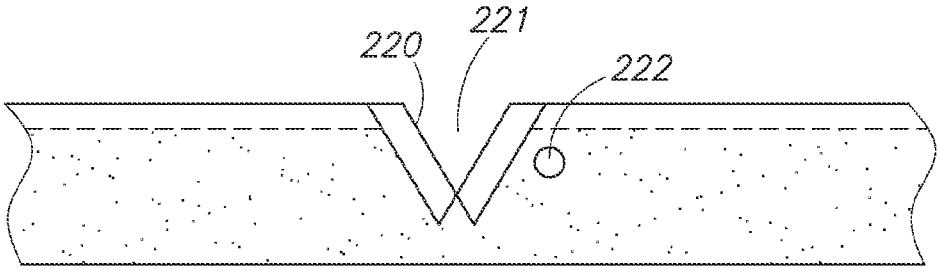

FIG. 44 is an exploded top view of the present invention. FIG. 44 is a another exploded top view, this time showing the Fold Location Indicators located at the halfway points on the sides of the Towel.

Figure 45:
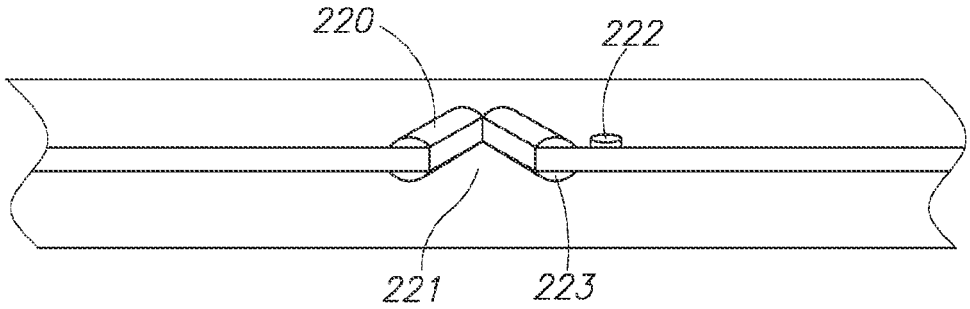

FIG. 45 is an exploded side view of the present invention. FIG. 45 shows an exploded side view of the fold location Indicators. It illustrates how the stitching can be used as a tactile mechanism for locating the fold area and provides the ability to tell the difference between one side of the towel and the other on one side the stitching is raised higher than the other and may be of a thicker thread.

Figure 46:
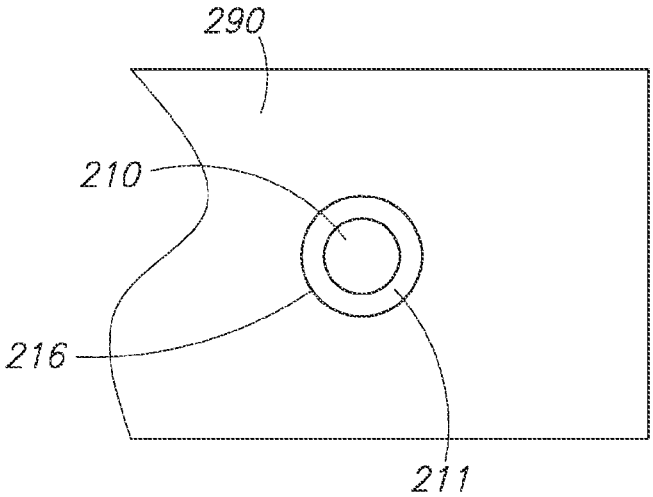

FIG. 46 is an exploded top view of the present invention. FIG. 46 is an exploded top view of the "Hole For Bottle." It is one of two holes in the towel. It shows a rubber or elastic material stitched to the inside of the hole. Molding elastic material directly to the Inside of the hole may be an alternative to stitching.

Figure 47:
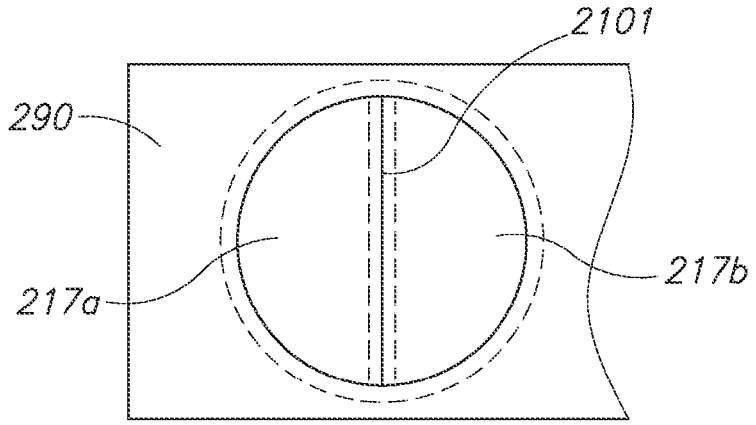

FIG. 47 is an alternative embodiment of the holes of the present invention. FIG. 47 shows an alternative embodiment to the Hole For Bottle shown in FIG. 42 and FIG. 46.

Figure 48:
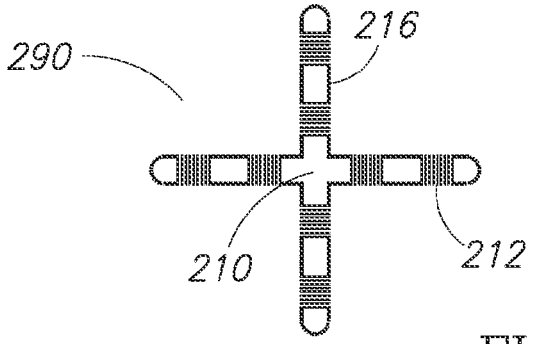

FIG. 48 is an alternative embodiment of the holes of the present invention. FIG. 48 shows another alternative embodiment of the Hole For Bottle shown in FIG. 42 and FIG. 46.

Figure 49:
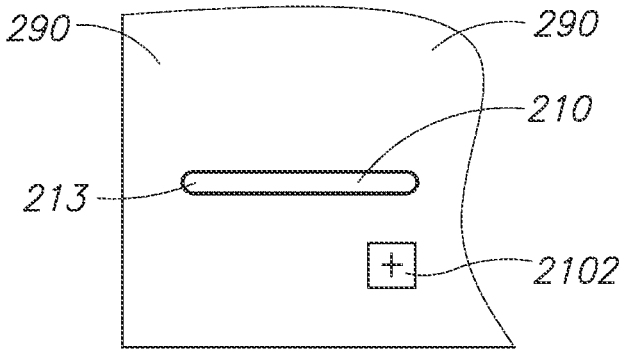

FIG. 49 is an alternative embodiment of the holes of the present invention. FIG. 49 shows another exploded view of a alternative hole style to the hole shown in FIG. 42 and FIG. 46.

Figure 50:
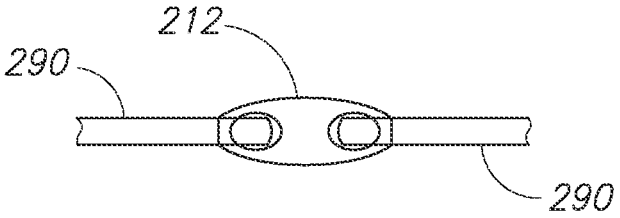

FIG. 50 is an exploded side view of the present invention. FIG. 50 shows an exploded side view of FIG. 48. This provides the ability to view how the Semi-permanent Stitch relates to the rest of the hole.

Figure 51:
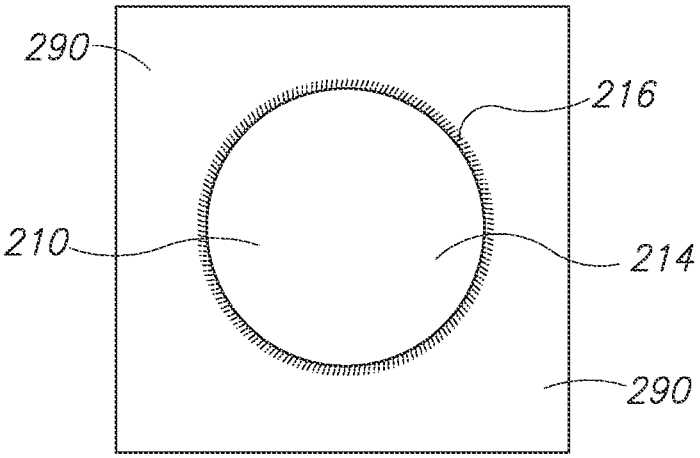

FIG. 51 is an exploded to view of the present invention. FIG. 51 shows an exploded top view of another Holes For Bottle alternative.

Figure 52:
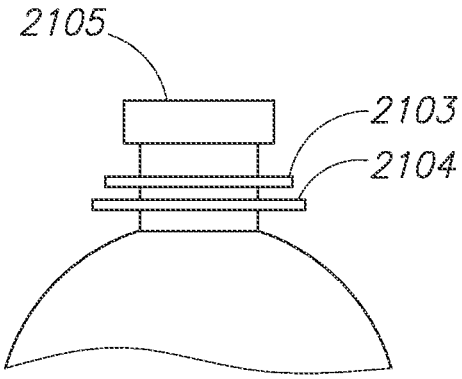

FIG. 52 is an exploded side view of the present invention. FIG. 52 shows an exploded side view of a bottle that is specifically designed to receive a towel with the Holes For Bottle technology.

Figure 53:
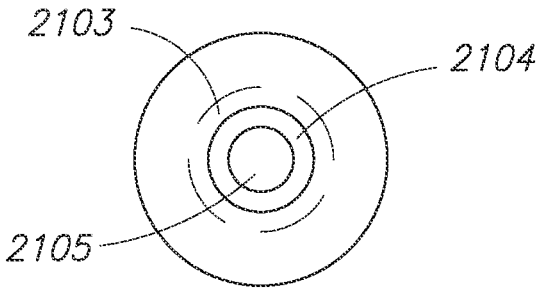

FIG. 53 is a top view of the present invention. FIG. 53 shows the top view of a bottle specifically designed to receive a Towel with "Holes For Bottle" technology.

Figure 54:
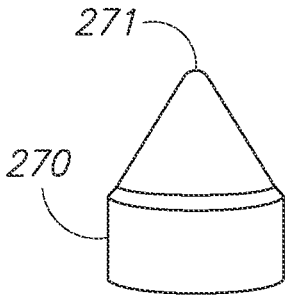

FIG. 54 is a side view of the present invention. FIG. 54 shows a side view of a bottle cap that would allow for an easier application of a Towel onto the bottle. Alternative bottle caps would be sold as accessories or be included with bottle that are specifically designed to work with Towels that have "Holes For Bottle" technology.

Figure 55:
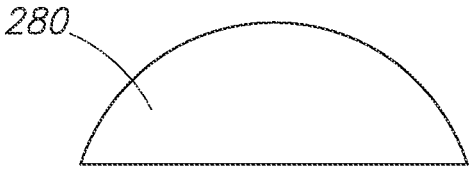

FIG. 55 is a top view of the present invention. FIG. 55 shows a top view of a Gel Pack. A Gel Pack is either permanently attached to the Towel or is inserted into a pocket located on the towel.

Figure 56:
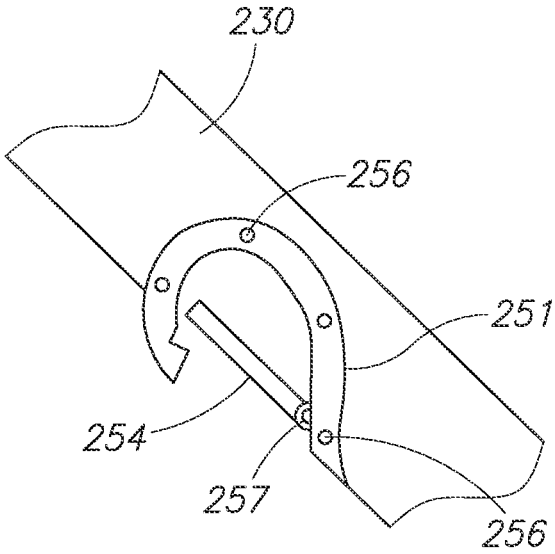

FIG. 56 is a front view of the present invention. FIG. 56 show a side view of a carabineer that is incorporated into the "Tether" of the "Towel." It could similarly be incorporated into the "Towel" its self.

Figure 57:
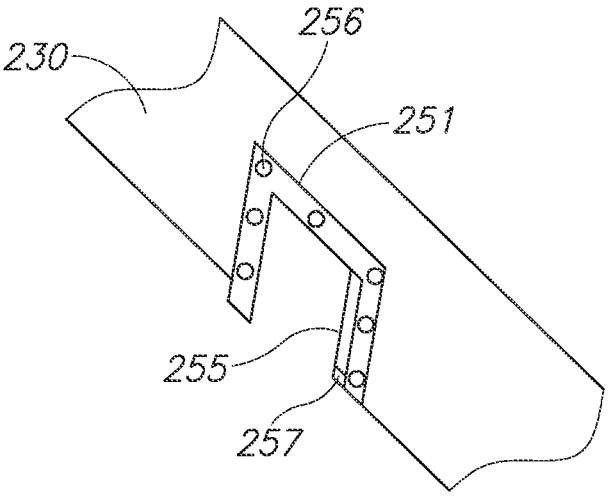

FIG. 57 is a side view of the present invention. FIG. 57 shows a side view of an alternative carabineer (however more than one carabineer may be used on a "Towel"). The arm on this carabineer is not spring loaded. It will click and lock in either the open or closed position.

Figure 58:
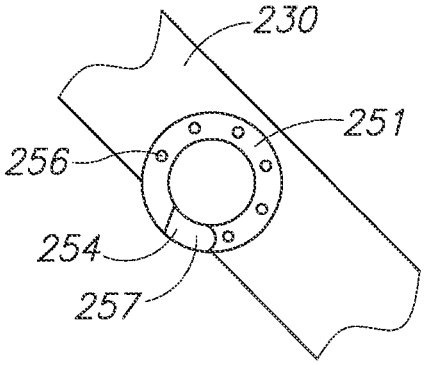

FIG. 58 is a side view of the present invention. FIG. 58 is a side view of an alternative carabineer that can be incorporated into the "Towel."

Figure 59:
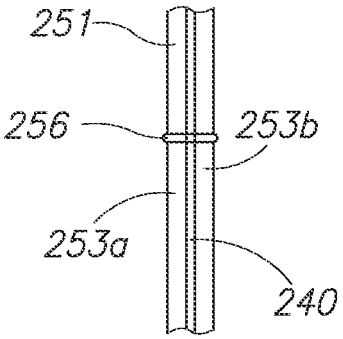

FIG. 59 is a side view of the present invention. FIG. 59 shows a side view of a "Towel" incorporated carabineer, illustrating certain embodiment for attachment to the towel.

Figure 60:
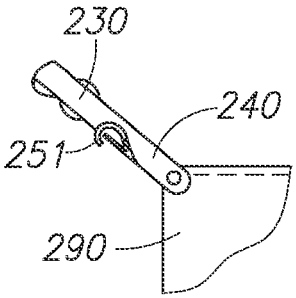

FIG. 60 is an exploded top view of the present invention. FIG. 60 (251) shows an exploded top view of the towels "Tether," showing where a carabineer could be located.

Figure 61:
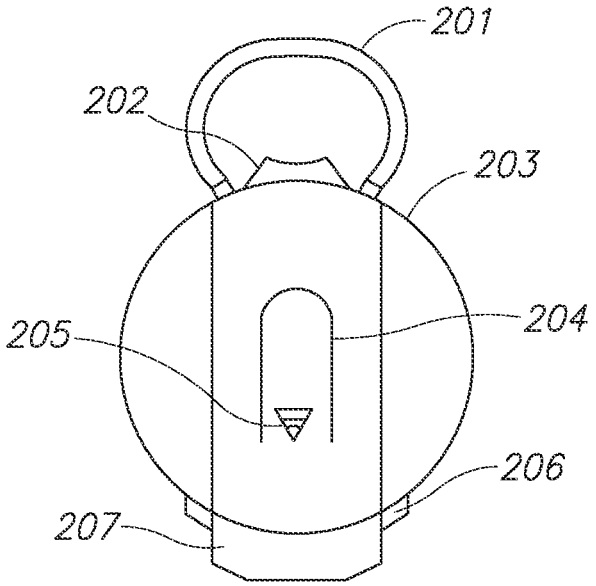

FIG. 61 is a front view of the present invention. FIG. 61 is a front view of a product that provides "hanging functionality" to any Towel, cloth, piece of clothing.

Figure 62:
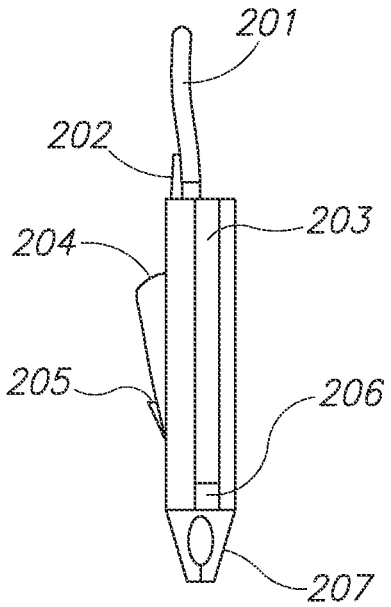

FIG. 62 is a side view of the present invention. FIG. 62 shows a sided view of FIG. 61.

Figure 63:
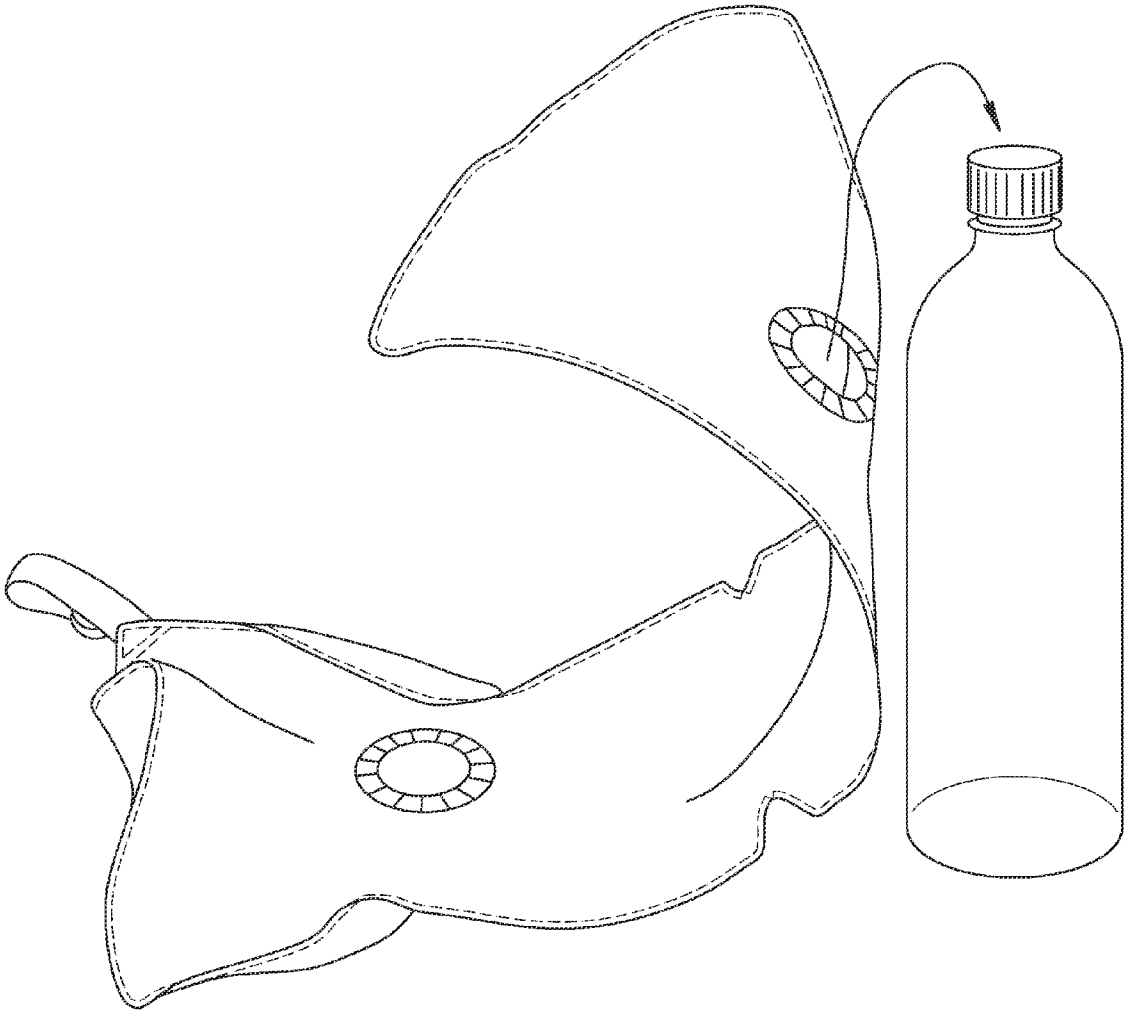

FIG. 63 is a 3D drawing of the present invention. FIG. 63 is a 3D view of the Towel and shows step 1 in a way the Towel can be used with a bottle in order to keep it from coming into contact with unwanted dirt.

Figure 64:
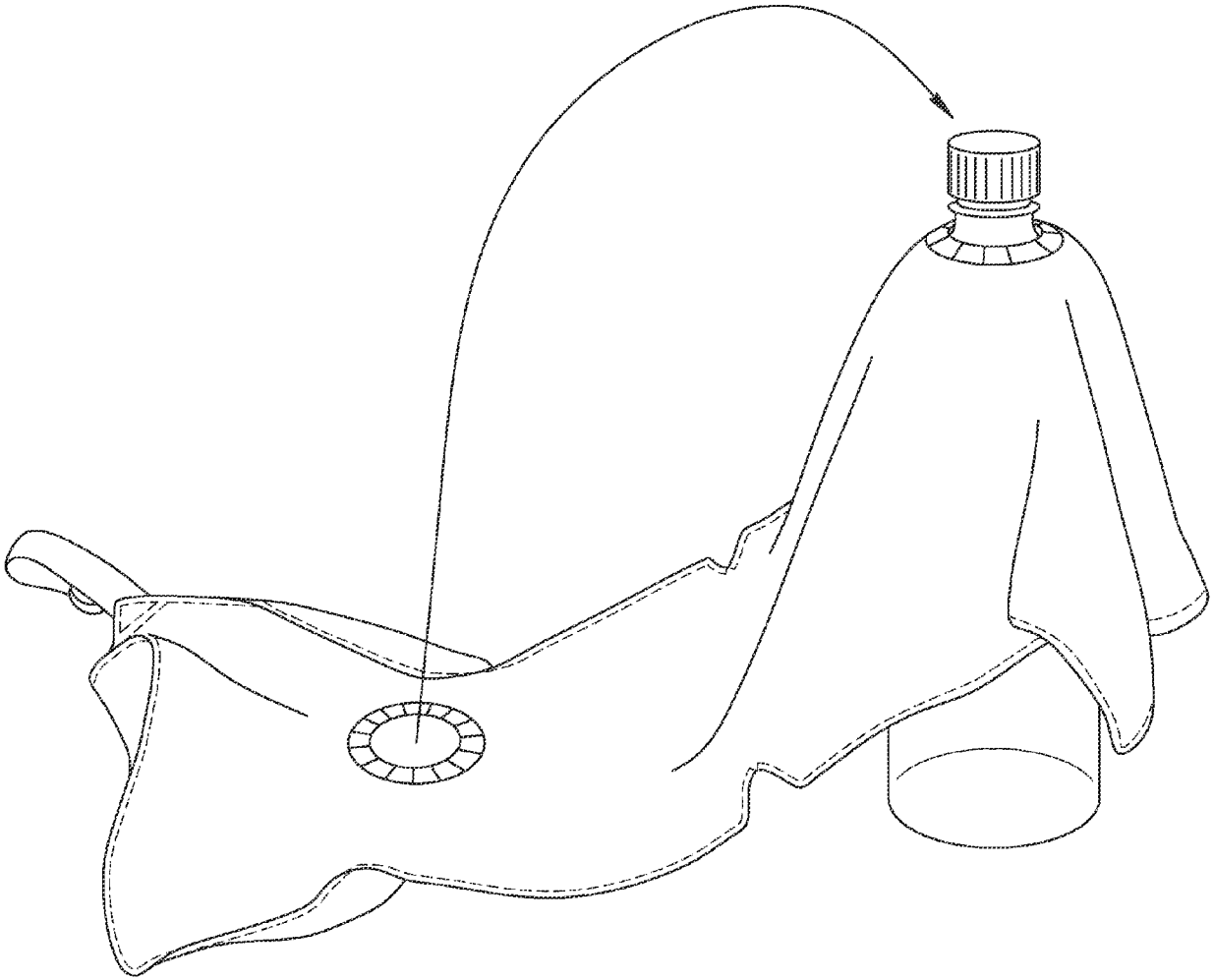

FIG. 64 is a 3D drawing of the present invention. FIG. 64 is a 3D view of the Towel and shows step 2 in a way the Towel can be used with a bottle in order to keep it from coming into contact with unwanted dirt.

Figure 65:
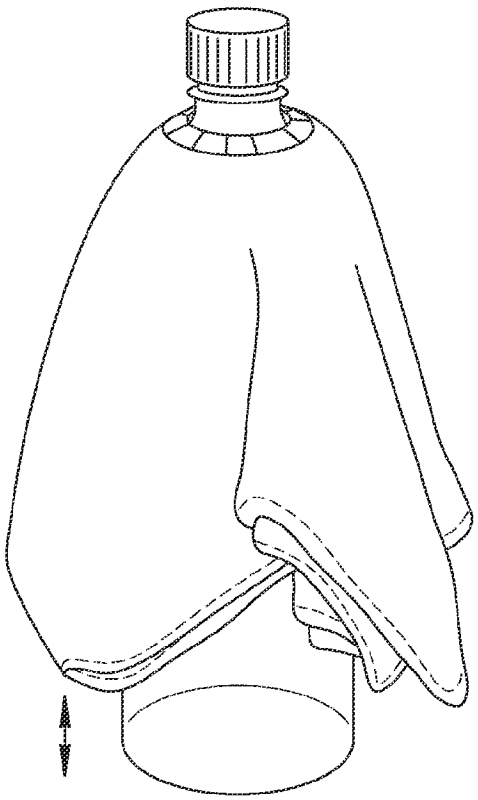

FIG. 65 is a 3D drawing of the present invention. FIG. 65 is a 3D view of the Towel and shows step 3 of 3 in a way the Towel can be used with a bottle in order to keep it from coming into contact with unwanted dirt.

Figure 66:
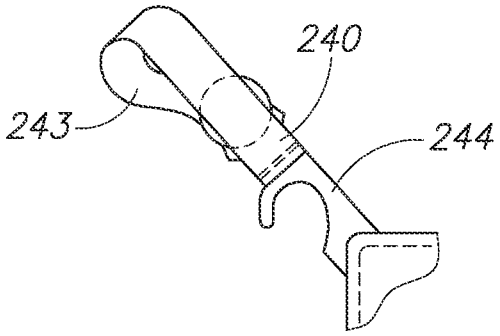

FIG. 66 is an exploded top view of the present invention. FIG. 66 shows an exploded top view of a "Tether" variation.

Figure 67:
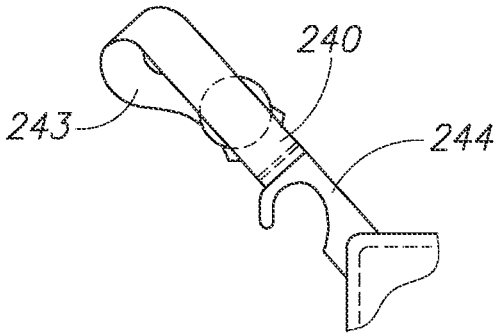

FIG. 67 is an exploded top view of the present invention. FIG. 67 shows an exploded top view of another "Tether" variation that incorporates a traditional Carabineer.

Figure 68:
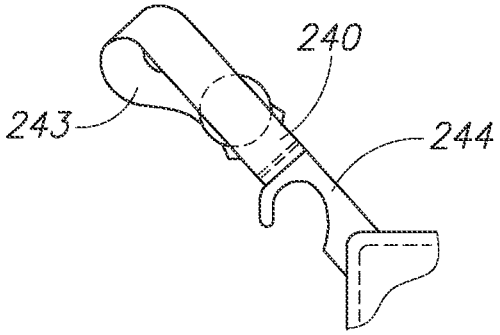

FIG. 68 is an exploded top view of the present invention. FIG. 68 shows an exploded top view of a "Tether" that incorporates the use of Velcro.

Figure 69:
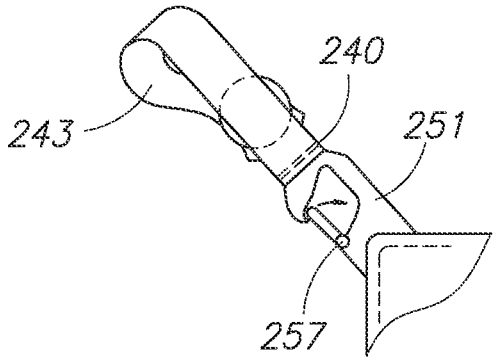

FIG. 69 is an exploded to view of the present invention. FIG. 69 shows an exploded top view of yet another variant of the "Tether." Notice the uniquely incorporated carabineer.

Figure 70:
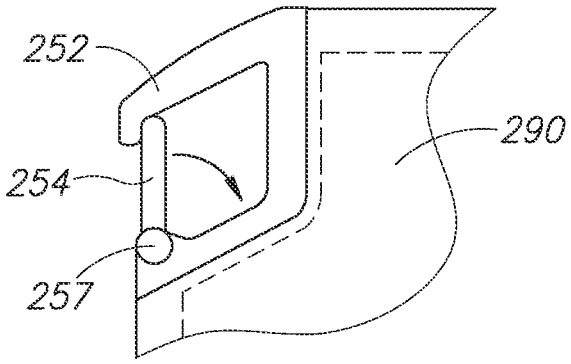

FIG. 70 is an exploded to view of the present invention. FIG. 70 shows an exploded top view of a carabineer that in sewn into the corner of the "Towel." This technique could be used to incorporate a carabineer anywhere on the "Towel" or the "Tether."

Figure 71:
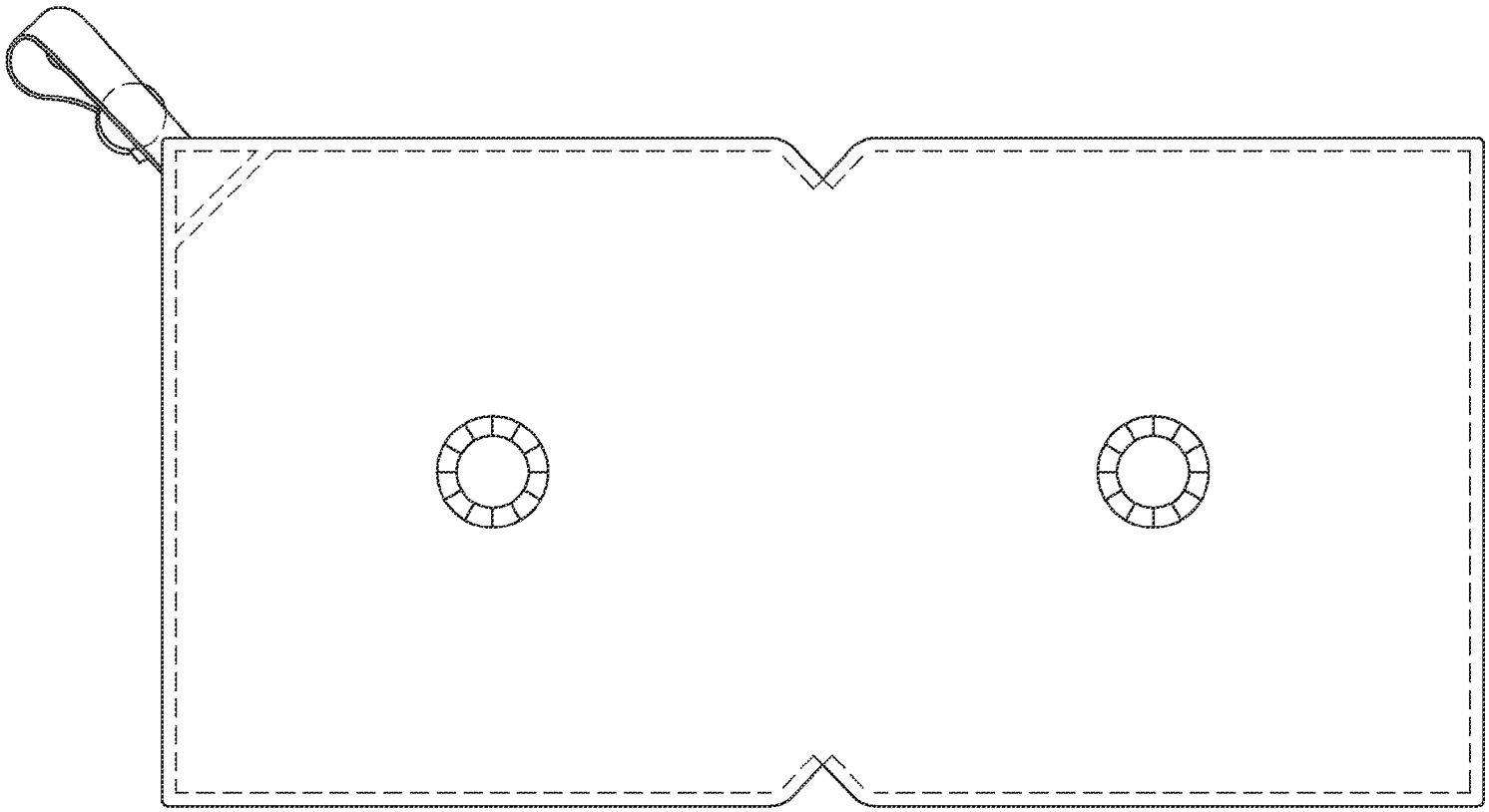

FIG. 71 is a top view of the present invention. FIG. 71 shows another variant top view of the entire "Towel."

Figure 72:
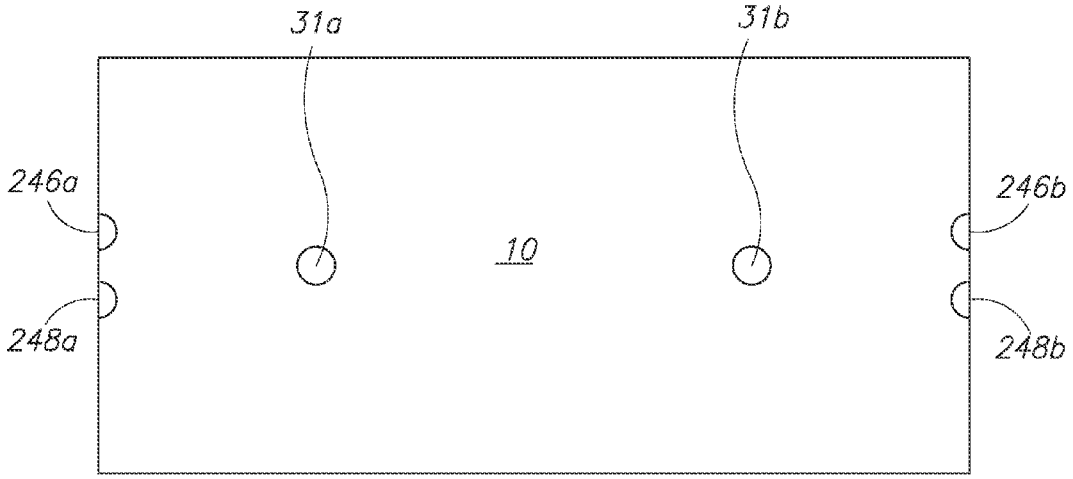
Figure 73:
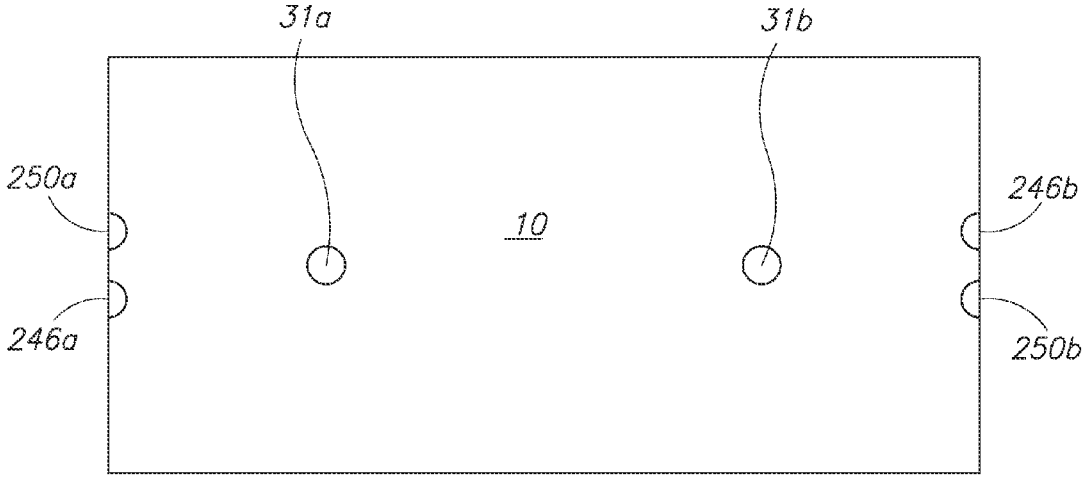

FIGS. 72-73 are top and bottom plan views of an alternative embodiment of a sports towel.

Figure 74:
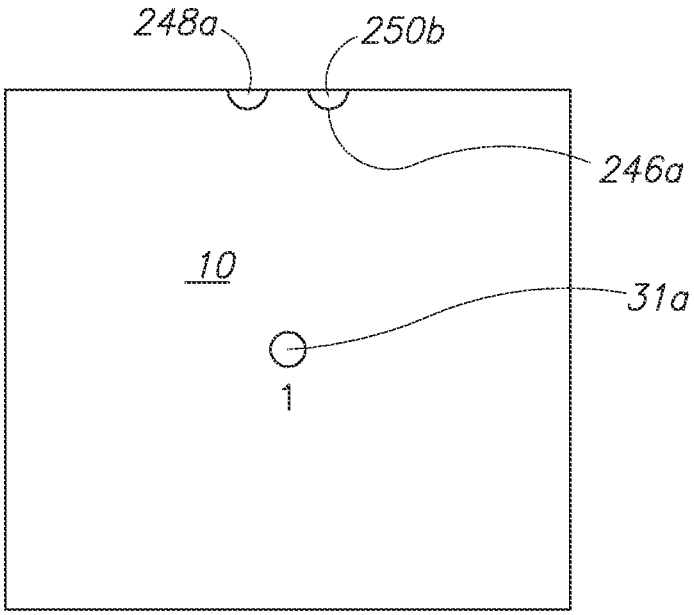
Figure 75:
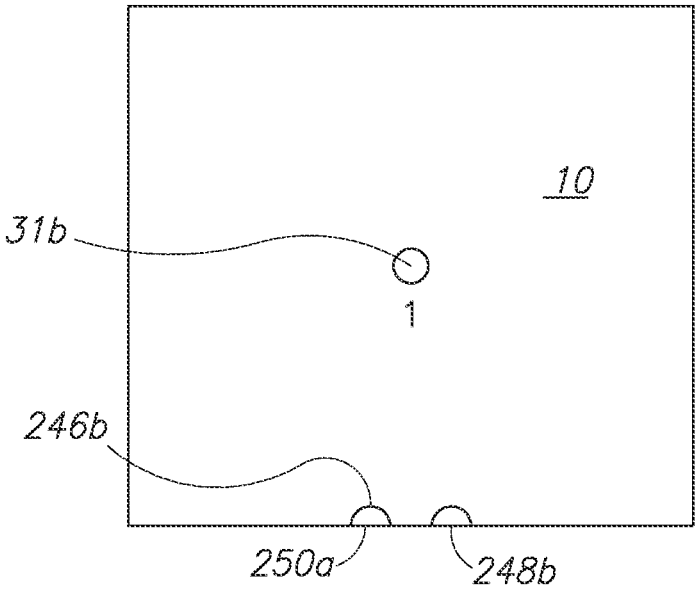

FIGS. 74-75 are top and bottom plan views of the embodiment of FIGS. 72 and 73 in a folded configuration.

DETAILED DESCRIPTION OF THE PREFERRED EMBODIMENT

Overview:

Turning now descriptively to the drawings, in which similar reference characters denote similar elements throughout the several views, the FIGURES illustrate the towel material, the various hooks, holes for bottle styles and placement, magnets for hanging, various fold indicators and making it easier to grip the bottle with towel on bottle.

Towel Material:

The Towel Material is a water and oil absorbent material made of natural and manmade properties. It can be designed to dry quickly, and/or remain surface dry at all times and/or be a disposable product. Disposable or semi disposable towel material created from nonwoven materials of various formulas can be laminated together to create a towel that wicks water away from the skins surface and delivers it to a in layer of material that absorbs and holds the water leaving the towel surface primarily dry. The towel material (FIGS. 13, 14 34) is any cloth, made of natural or manmade elements that show wicking characteristics.

Some towel materials, when cut, will begin to fray at the point of the cut. To prevent this, the exposed cut will need to be sealed. One way is to stitch it (FIGS. 33-11). Gluing and heat sealing may be possible alternatives. This is typically required with woven materials.

Nonwoven materials (FIGS. 34, 35) do not require hemming. This provides a little more flexibility in design and cost saving step. Nonwovens can be laminated to other nonwoven layers (FIG. 26) or even woven materials to create new and innovative materials. To achieve the desired characteristics in a woven material it may be necessary to create a towel material "from the ground up".

In order to get the material to drape properly the weave can be adjusted in specific areas to achieve the best drape. The height of the towel's pile can also be adjusted in strategic areas to improve both the drape and the materials wicking ability. Holes and relief cuts can also be used to improve the towel materials ability to wick water.

All of the above variations to the woven material can also be made to nonwoven materials using different techniques. Various formulas can be used to achieve specific wicking characteristics and a certain feel to the hand. The drape can also be controlled through the materials. Thickness, strategic embossing, and perforations.

Hooks or Loops (Means by which to Hang the Towel)

Hooks are used to hang the towel out of reach of contaminants. There are several unique ways by which this can be obtained. Each way may be more appropriate to a specific environment. Some hooks may have more versatility than others. Hooks and loops may be used to hang the towel from objects other than the bottle (with the exception of FIGS. 35-31*a*, 31*b*) or the way you may attach other objects, keys for example.

Hooks and loops may be made of the towel material itself (FIGS. 35-33, 34-33). Or they can be made of various other materials and fastened to the towel material (FIGS. 18, 37). The imbedding of rope, elastic cords, wires, wires with additional features like suction cups (FIG. 29). Hooks and loops can either be fashioned out of or incorporated into corporate logos (FIGS. 17, 18).

Rubber coated wires imbedded into the towel can have additional means by which to hang the towel incorporated into it. The hooks and loops can be located at any corner or anywhere around the perimeter of the towel. Hooks and loops can also be used within the field of the towel (no picture at this time). For example, a loop could be used as a alternative for a hole for bottle. Hanging the towel from a bottle using a loop(s) within the towels field.

Holes in Towels

The Hole or Holes allow the bottle's neck to pass through the towel material. The bottle may advantageously be used as a stand for the towel, keeping it from touching any potentially contaminated surfaces while allowing you to drink from the bottle without removing the towel. The above is one reason a hole may be placed in the towel material. Another is to all wicking of liquid through the top layer of towel material to an underlying layer. They kind of act like a cheese grater in that they help remove liquid from a surface, allow it to pass through, and be deposited in another location.

Another purpose of holes is to give a towel higher draping characteristics. Or, allowing a towel to be predisposed to resting in a specific manor. This could also be a slot or the removal of some strategic portion of the towel. Holes are also used to hang the towel with the size and shape of hole for hanging is a matter of aesthetics.

There are many reasons for Holes in Towels. One is the holes for receiving a bottle (FIGS. 33-31*a* and 31*b*), (FIGS. 35-31*b*1 and 31*b*2), (FIGS. 39-41). These are the holes that allow the towel to rest on the bottle while still allowing you to drink from the bottle.

Another type of hole for a bottle allows the towel to be locked to the bottle (FIGS. 31-32*a* and 32*b*). This is done by placing the bottle through the holes and twisting the towel. Possibly one of the simplest was to create a way to hang the towel is to simply put a hole in the corner of the towel (FIGS. 13-33) (FIGS. 31-33). Even these simple holes can be improved (FIG. 27). By adding the elastic ring the hole will maintain its shape and be more form fitting to many objects.

Other reasons for placing holes in a towel are for wicking purposes. The holes allow the to quickly wick to the core of the whether it be a woven or a nonwoven (FIGS. 23-34). Another use for strategically placed holes in a towel is for contouring holes place properly will allow flow over a object. A comparison could be drawn between the placing of canvas tarp over a large object vs. the placement of a fishnet over the same object. The fishnet will follow the contours of the object more readily.

Holes for towels can come in various sizes and shapes. Some may help remove the moisture from the surface quick while other shapes may help the towel dry faster once it's wet. A set of small holes can be use to create a line in the nonwoven material variant of the towel so that it can be easily torn.

Magnet

Magnets may be incorporated into the towel to allow another means of hanging the towel. Magnets, if permanently fixed to the towel, can be used to hang the towel from metallic objects. There are several ways that the magnet can be incorporated into the towel.

One way is to incorporate it directly into the towel (FIGS. 3-73). This is done by folding the corner over and stitching the magnet under the fold. It can be sandwiched between the towel and another piece of material (FIGS. 16-41). A similar but different way of introducing the magnet to the towel is via the hooks and loops. By incorporating the magnet into the design of the hanging mechanism (FIGS. 18-73).

Fold Indicators

Fold Indicators identify where the towel should be folded in order for the holes to line up (if more than one hole) so that the bottle can pass through. Fold indicators are any means by which the two locations on the where it needs to be folded in order for the two holes to line up are identified. This could be done a couple of ways. One, by removing a piece of material from both sides of the towel or, altering the shape of the towel (FIGS. 15-51) (FIGS. 31-50. Two, by adding physical markers (FIGS. 31-52). Both techniques have their advantages.

Bottle Gripping

It is important to be able to grip the bottle securely while the towel is placed of the bottle. When the towel is placed over the bottle, entirely covering it, the bottle becomes a bit more difficult to grasp. The towel adds bulk to the bottle making it especially difficult for small hands to grasp. The towel also creates a slippery condition. The towel will slip a little against the bottle when attempting to grasp.

One method for reducing the slippage between the towel and the bottle is by attaching rubber nodes to the towel (FIGS. 28-61). They can be placed randomly or in a pattern that works in harmony with how the towel drapes over the bottle.

Other ways to prove better gripping is through the use of the holes for contouring (FIGS. 23-35). By reducing the amount surface area on the towel and allowing the skin from ones hand to pass through the towel and to come into contact with the bottle surface a better grip can be achieved.

Another way for achieving a better grip is by augmenting the towel (FIGS. 31-62*a*, 62*b*). When the towel is folded over the slits in the towel will line up. When placed over the bottle one can pass their hand through the slits and grip the bottle directly. Changing the shape of the towel is a very good way to get better gripping results.

Another way to achieve better gripping is through the placement of the holes for the bottle (FIGS. 35-31*a*, 31*b*) (FIGS. 35-31*a*1, 31*b*1) (FIGS. 34-31*a*, 31*b*). These hole combinations will place the towel off center of the bottle. This will expose a portion of the bottle for easy gripping. Using this technique will reduce the size of a traditional, rectangle shaped, towel. That can be placed on the bottle without it touching the ground. As a result, in order to get more towel surface the shape of the towel will have to be changed. Rounded on the end for example.

Cut Corner

A rectangular towel with one of the corners cut, removing a triangular piece, provides a platform from which hooks and other brand identifiers to be attached. The cut corner look can also be achieved by folding a corner over which open other possibilities.

The cut corners are not only a brand identifying mark but provide a platform from which logos (FIG. 18) can be attached. It provides a quickly identifiable location for attached hooks and magnets. The cut corner look can be achieved by folding the corner of a traditionally shaped, rectangle, towel over. This not only creates the brand look but provides a technology for imbedding hooks made of rope, wire, elastic cord, ribbon, string as well as magnets (FIGS. 1, 17, 18 and 19).

A cut corner could be any alteration of the towels corner that makes it easier to attach accessories or that creates a synergistic platform for incorporating logos.

Towel Shapes

The sports towels that work in conjunction with a bottle or hydration system may be cut to specific shapes to achieve goals. In particular, a towel may be shaped and sized to provide a safe product, keep the towel off of unwanted dirty surfaces, be effectively absorbent, and be marketable. Many of these objectives may be achieved by the material from which the towel is made but from the shape of the towel itself (see attached photos).

The shape of the towel can allow for better gripping of the bottle by leaving some of the bottle exposed when the towel is on the bottle. The augmentation of the as show in (FIGS. 31-62*a*, 62*b*). Please see photos to view possible shapes for allowing clear exposure to the bottle.

When using the bottle as a stand for the towel in a effort to keep the towel off the surface of which the bottle is resting, the size of the towel can be limited to increase the amount of towel surface the towel shape can be altered. By rounding the corners of a traditionally shaped towel it's body can be widened and lengthened (see photos). Also, if you wanted to stack a large towel on top of a bottle you could use more holes for bottle (FIGS. 33-31*a*, 31*b*).

The shape of the towel after being folded and place on the bottle will show flying characteristics when the bottle is pulled through the air by its cap. This does require the proper shaped towel. The result is a brandable, marketing product. The flying characteristic (spreads open like raised bird wings) also allows the towel to dry faster after. It has become wet as a result of use.

A slight variant of the product mentions above is more reminiscent of a cape a super hero would wear. This shape of towel not only has all the functional characteristics of a sports towel but has the additional branding and marketing potential. The towel's shape may have a functional and synergistic relationship with the bottle.

Laminated Nonwoven Material

A laminated nonwoven material is one cloth that is made up of one or more separate cloths. This is done by gluing or melting them together. Laminated nonwoven materials are not all the same. They have different characteristics. One type may be better at holding moisture and another may be better at wicking moisture off of a surface. Another may have a better feel to the hand. Another may have a nice drape ability to it. Lamination may be used to combine these separate materials to create one (FIG. 26).

For example, two layers of wicking material (FIGS. 26-91) sandwich one layer (FIGS. 26-92) of highly water retentive nonwoven material. This creates a sports towel that will stay dry to the touch. The number of nonwoven layers in a sports towel can vary. For example, one half of a towel can have more layers and a different combination of nonwoven types than the other half (another section) of the towel.

Perforations

Strategically place small holes to allow for easy tearing in a predetermined way. Perforations are a series of small holes in a material that make it easier to tear that material in a predetermined way (pattern). When perforations are applied to a nonwoven sports towel it allows for the resizing of the towel to fit a specific need. For example, a one size fits all sports towel for bottles could be sold. However, not all bottles are the same size. The perforations would allow you to tear off what needed and keep only the appropriate material. For your size bottle a example is shown in red (FIGS. 38-101).

An example of how the perforations can be incorporated in a sports towel for bottles. Nonwoven towels could be sold by the roll or individually. To begin with the towel may look like any other towel until you look closer and see the perforations in it. These perforations would allow you to punch out the appropriate size hole for the bottle. Punch out a hook for hanging. Tear off the appropriate amount for the height of your bottle. Tear out fold indicators. A one size fits all product.

Connections of Main Elements and Sub-Elements of Invention

The towel material (10) is one of the largest elements. It's what most of the other elements are attached to. Depending upon the type of material, stitching (11) may be used to prevent the towel material from falling apart. This is typically true with woven materials. Nonwoven materials don't have this issue and can be cut without fear of fraying.

The towel material, when used a sports towel, will require a means by which it can be hung in order to keep from coming into contact with dirty object that are found in a gym environment for example. The use of hooks and loops (20) is one technique in general. The imbedding of material into the towel that can be used to hang the towel is a method that achieves this. For example, imbedding a flexible rubber coated wire (21) fashioned as a loop provides a way to hang the towel. By placing the loop over an object, it also can be bent into the form of a hook increasing the likely hood of finding a place to hang it in any environment. The hooks are created from many materials including rope (24), elastic cord (27), and ribbon. In some embodiments, the loops and hooks can be fashioned into corporate logos and other decorative objects (25).

Holes (30) may be placed into the towel material (10) for several reasons. Holes for bottle (31) may be used as an alternative method to keep the sports towel off of dirty surfaces. In some embodiments, the holes may be defined by one or more loops within the field of the towel as an alternative way of hanging the towel from the bottle. In another alternative, a bottle cap may be built into the towel. In order to keep the towel secured to the bottle a locking mechanism (32) can be fashioned. Holes may also be used to hang the towel from objects (33). Holes may also be used in the material to aid in the wicking of moisture off of a surface as well as aiding in the quicker drying of the towel. Some towel materials don't drape as well as others so with the aid of strategically placed holes the towel can achieve a better drape or contour (35).

The towel material (10) may be used as a sports towel in environments where the easiest way to hang the towel out of the way is to attach it to a metal object via a magnet that's incorporated into the towel (41). When the towel material (10) is fashioned into a sports towel with holes (loops, cap) for bottle (31) incorporated it may advantageously be folded, if more than one hole (31), in order for the holes to line up and allow the bottle to pass through both. To make it easier and quicker to identify where the towel needs to be folded the towel may include fold indicators (50). A cost effective way to create fold indicators is pinching the towel material in the appropriate areas and permanently stitching it (51). Another is by using a raised surface (52) attachment. Another cost effective is by using a raised stitch or embroidery technique.

Dependent upon the type of towel material (10) used, the bottle's ability to be gripped while the sports towel is on the bottle will vary. Bottle gripping (60) may be a safety concern and can be eliminated using several technologies. One being the addition of rubber grippers (61) to the towel material (10). Another is by augmenting the towel (62) to allow ones hand to easily grasp the bottle directly. Another is the placement of the holes for bottle (63) (loops, imbedded cap). The closer the two holes are placed together the more the towel will be displaced to one side of the bottle, allowing clear and direct access for the hand to grasp the bottle. Another way is by creating a unorthodox shaped towel (81) that purpose is to allow for better gripping of the bottle.

The towel material (10) and the towels final shape (80) can vary dependent upon the characteristics desired. As mentioned above, the shape of the sports, for example, can help improve the associated bottles ability to be grasped (81). A traditionally shaped rectangle towel, when placed on the bottle tends to be small in size because the corners touch the surface the bottle is sitting on. By changing the shape of the towel (82) a larger piece of towel material can be placed on the bottle without it touching any other surface than the bottle itself. Special characteristics can also be achieved, a towel that shows flying characteristics (83) is one. A towel that is shaped like a super hero's cape (84) is another.

Not all towel materials (10) are created equal. By using nonwoven towel materials as a building block. Nonwoven materials with different characteristics can be laminated (90) together to create a sports towel well suited for a given application. A simple example is by the laminating of two different types of nonwoven material (91 and 92) into a sandwich form. This achieves diaper like qualities, the middle holds the moisture and the surface stays dry to the touch.

Perforations (100) in the towel material (10), e.g. a little hole (or markers) that indicate where a towel can be torn easily or where it can be cut to achieve the desired result. An example of a result is sizing the towel appropriately to the specific bottle (101) to be used as a stand. Another example is to give a person options as to where the holes for bottle (31) are located. A regular looking, rectangular towel can be converted into various looking and functionally different sports or utility towels.

Alternative Embodiments of Invention

Variations and alternatives may be left up to the purchaser of the product.

Operation of Preferred Embodiment

The applications of this towel are much broader than that of just a sports towel. Dependent upon the type of material and some functionality variants, the towel can be used as a "bottle Blanket" to help keep the contents of the bottle at a consistent temperature or as a "bottle bib" to help prevent drips from a wine, or other, bottle from staining anything to a more utilitarian "Swiss Pocket knife" (industry specific) type of a product as examples.

The sports towel may be capable of being kept out of dirty environments until it is needed. Also, to be quickly and easily accessible. Also, to be a marketing tool. How the sports towel is capable of performing these functions are unique to this product.

Most of the unique features and technology that keep the towel out of dirty environments may also allow the towel to be quickly and easily accessible. For example the holes for bottle allow you to use your existing liquid container as a stand for your towel. Allowing you to keep it off the ground and near you at all times. The hooks and loops that are incorporated into the towel are modifiable enough to allow you to hang it from any nearby object or even one's person if necessary. The towel can be hung from a wide range of objects including metal (using magnets) to smooth objects like mirrors (using suction cups).

A version of the holes for receiving a bottle may be included in most variants of the towel disclosed herein. The idea is that you can carry a fairly large towel on top of a water bottle, for example, by folding it (using the fold indicators), making the towel more compact and aligning the holes. The towel can now be placed over the neck of the container and be carried as a unit. In order to make the towel and bottle work safely as a unit modifications to the towel's shape and other characteristics and additions can be made.

Another feature is the imbedded objects and materials that allow the towel to be hung in most any environment. Most likely to be used in conjunction with the "holes for bottle" but can be used as a standalone technique for hanging the towel, meaning no holes for bottle, only an imbedded wire for hanging incorporated into the towel for example. Imbedded objects for hanging the towel can range from wire to rubber bands to magnets to cord to suction cups. Most of these objects are located at an area of the towel called the cut corner.

The "cut corner" doesn't only give the towel a signature look but provides a platform from which imbedded object can be fashioned to work efficiently. This is also a prime area for which corporate branding can occur or to attach any related accessories. In some instances the cut corner or the cut corner look can provide manufacturing cost savings.

An additional use for the towel, using only the "holes for bottle", would be as a bottle blanket Using the towel to keep the bottle cool in hot and sunny environments or warm in cool environments. This would be achieved from the natural insulating characteristics from the towel material or with the addition of a insulating layer to the towel.

An additional use for the towel, primarily using the "holes for bottle technology, would be as a "bottle bib". For example, the towel could be fashioned to hang around the neck of wine bottle (this could also be achieved using a loop or loops alternatively to the "holes for bottle"). This would allow the pourer of the wine to use the towel to protect the local vicinity from and possible spillage. In the event of a spill the towel can be removed from the bottle and unfolded to begin the cleanup of large spills.

An additional use for the towel is as a disposable or semi-disposable product using paper or other nonwoven materials. The towel could be manufactured and dispensed on rolls. In a gym environment a user would remove a towel from the roll and then size the towel to fit his particular bottle size tearing the towel in predetermined areas along the perforations. The perforations give the user of the towel optional (predetermined) sizes to choose from. Perforations and other techniques can also be uses to determine where a towel of other materials (other than nonwoven) can be torn or cut to create a appropriate sized towel for the bottle or any other use.

The use of laminated nonwoven material can be used to create a readily disposable towel and to create a towel with specific characteristics. For example, a towel that has diaper-like qualities. A core that holds the moisture and outer layers the dry quickly. Laminated materials don't necessarily have to be a onetime use product. In fact some of these materials characteristics improve after being washed.

The shapes of the towels may vary. Each shape may have beneficial characteristics like flying, better bottle gripping for safety, more towel material on a bottle, quicker drying, more drape able. The shape of the towel will vary dependent upon its use: sports, marketing (the company), utilitarian, children for example.

Referring to FIG. 39, a towel 10 having two or more apertures 31*a*, 31*b* may be used in combination with a bottle 104. The towel 10 may have a handle 20 secured thereto, such as a corner thereof. The apertures 31*a*, 31*b*, towel 10, and handle 20 may be according to any of the embodiments of such structures disclosed herein.

The bottle 104 may define a neck 106 and a shoulder portion 108 that has significantly greater diameter, e.g. more than 10% greater, more than 50% greater, or more than 100% greater, than a largest diameter of the neck 106, exclusive or inclusive of any cap secured to the neck 106.

The apertures 31, 31*b* may have an undeformed diameter that is larger than or equal to the largest diameter of the neck 106 exclusive or inclusive of any cap secured to the neck 106. Alternatively, the apertures 31*a*, 31*b* may be smaller than some or all of these dimensions but be deformable to fit onto the neck 106. In some embodiments, the apertures 31*a*, 31*b* are sized such that the apertures 31*a*, 31*b* may not be deformed to fit over the shoulder portion 108 without one of permanently deforming or tearing.

Referring to FIG. 40, in use, a first aperture 31*a* is placed over the neck 106, such as by sliding the aperture 31*a* over the neck 106 until the towel 10 rests on the shoulder portion 108. Referring to FIG. 41, the second aperture 31*b* may also be placed over the neck 106 such that a portion of the towel 10 surrounding the aperture 31*b* rests on the portion of the towel 10 surrounding the aperture 10*a*. In the illustrated embodiment, the towel 10 may be folded in half. In other embodiments, the towel may be folded into quarters and have four apertures 31 positioned in each quadrant of the towel. In other embodiments, the towel may have a tri-fold configuration and have an aperture 31 positioned in each panel of the trifold. Other numbers of panels or folds may also be used with corresponding numbers of apertures 31.

As noted above, embodiments disclosed herein advantageously maintain the towel 10 offset from a surface supporting the bottle 104. For example, a distance 110 between a lowermost edge of the towel 10 and a lowermost surface of the bottle 104 may be nonzero. In particular, a distance 110 between an edge of an aperture 31*a*, 31*b* and either an edge of the towel 10 or a fold line between the apertures 31*a*, 31*b* may be shorter than the length of the surface extending from the base of the neck 106 to the lowermost surface of the bottle 104. In some embodiments, the distance 110 is less than a height of the bottle 104 from the lowermost surface to a top of the neck 106 or a base of the neck 106. The base of the neck 106 may be defined as an inflection point between a concave surface of the neck and a convex surface of the shoulder 108. For purposes of this disclosure, the distance 110 being less than any of the above measurements may be interpreted as being more than 1 cm less, more than 5% less, or more than 10% less, any of these measurements.

Overview

Turning now descriptively to the drawings, in which similar reference characters denote similar elements throughout the several views, the figures illustrate ways that a towel can be kept from coming into contact with unwanted contaminants and providing additional utilitarian functions.

Hole for Bottle

A bottle hole of various designs and sizes is used primarily for the insertion of a object (bottle) that will keep the towel from coming into contact with unwanted contaminates. If the towel is of size to require more than one hole, a "fold location indicator" will assist in properly folding the towel in a way that will allow all the holes to line up so that a object can go through all of the layers. There are two holes (penetrations) FIG. 42 (210*a*) and (210*b*) in an athletic sized towel that when the towel is folded in half the holes will line up and all the towel to be slipped over a bottle, that may be on the floor, and used to keep the towel from coming into contact with the floor its self.

Illustrated in FIG. 63-65 a larger towel may require more, appropriately spaced, holes to gain the desired result.

The holes (210*a*) and (210*b*) shown in FIG. 42 have an elastic band (211*a*) (211*b*) attached to the perimeter of the holes to help accommodate various size bottles and help provide a secure fit when around a bottle.

There are various ways to design the holes and various materials. Used to allow a hole to accept various sized bottles and stay securely attached FIGS. 46-51.

FIG. 46: The towel (water absorbent material) (290) is shown with a hole (210) in it where the bottle will go thru. A rubber (elastic material) (211) is attached to the towel with some stitching (216).

FIG. 47: The "Towel" (water absorbent material) with a hole covered with a couple pieces of neoprene (elastic material) (217*a*) (217*b*). These two halves (217*a* and 217*b*) are attached to the interior side of the towel hole. Between the two pieces of neoprene (217*a* and 217*b*) slit is created (2101) where the bottle can be pushed thru. A pocket can also be created in the neoprene of the towel material that would allow for the insertion of a freezable gel pack FIG. 55 (280) for cool refreshment on the face or to help keep the contents of the bottle stay cold.

FIG. 48: The "Towel" (water absorbent material) (290) with a "plus" (+) shaped hole (210). The perimeter of the hole is stitched to prevent fraying (216). Semi-permanent stitching (212) or elastic material so it can be removed if the bottle is too large for the hole indicated by FIG. 48 (210). FIG. 50 (210) shows a side cutaway view of the removable material.

FIG. 49: The Towel (water absorbent material) (290) shown in FIG. 49 with a narrow horizontal hole (210) or a slit-cut (213) in the "Towel". This is one of two holes in the towel. The second hole would be vertical in relation to the hole shown in FIG. 49. When the "Towel" is folded in half the two holes would form a cross pattern (2102) to allow a bottle to pass thru. Towel friction will all for some adjustability in the size of the hole, allowing variable bottle sizes to be used.

FIG. 51: The towel (water absorbent material) (290) has a circular hole (210) (214) that is stitched at its perimeter FIG. 51 (216) to prevent fraying.

Bottles can be specifically designed to accommodate the "Hole In Towel" technology FIG. 52 for example, a specific hole size can be created to work with a specific bottle. The bottle in FIG. 52 has two rings built into its structure FIG. 52 (2103) and (2104). A towel with a hole barely big enough to fit over ring (2103) will be able to be forced over ring (2103) locking the towel between ring (2103) and ring (2104).

Yet another method for providing variable adjustability in the size of the hole (not illustrated) is with the use of a draw-string (215). Drawing the string tighter will shrink the size of the hole in the towel. When a hole is appropriately sized it can be secured for use.

Fold Location Indicators

A "Fold Location Indicator" is a physical marker at opposing sides of a towel that will allow identification of what side of the towel is which and indicate where to fold the towel so that the "Towel Holes" line up perfectly. The Fold Location Indicators can be of notch or slit in design and/or have a raised surface that would indicate where to fold and allow identification of one side of the towel from the other without looking.

The "Holes For Bottle" FIG. 42 (211*a*) (211*b*) are positioned on the "Towel" so that when the towel is folded in half the holes line up and allow the bottle to go thru both holes. The "Fold Location Indicators FIG. 42 (221) FIG. 44 (221) FIG. 45 (221) are notches (various possible shapes) located at the middle along the edges of the water absorbent material. They allow quick identification of the folding points, without sight, and allow easy manipulation of the material, thus quick and accurate folding.

The Fold Location Indicators provides information. Using only sense of touch, identification can be made of the difference between the two sides of the towel. This can be achieved with the stitching involved in creating the notch FIG. 44 (220) FIG. 45 (220) (223) (the stitching on one side of the towel would be textually different from the other) or by the addition of a physical object FIG. 42 (222) FIG. 44 (222) FIG. 45 (222) to one side of the towel.

A Fold Location Indicator can be a relief cut FIG. 44 (220) (of various shapes) and/or the addition of a physical marker, for example: raised stitching, a button, different cloth material or other contrasting cloth material.

The Fold Location Indicators and its variations can be applied to other objects that require folding. For example: bath towels, beach blankets, bed linens & blankets, shop rags, clothing.

Magnetic Connector

The "Magnetic Connector" is a magnet that is extended from the perimeter of the towel so that it can be hung from metallic objects and kept away from contaminates. One of the sides of the "Magnetic Connector" can provide a point at which accessories can magnetically and mechanically attached to it. Accessories include but are not limited to music players, stop watch, clock, key ring, suction cup, hook, note pad, belt clip mechanism and identification holder.

Another method of keeping the towel (water absorbent material) from being contaminated with unwanted "dirt" is with the use of the "Magnetic Connector" FIG. 42 (230), the "Magnetic Connector" FIG. 43 (230) (231) (232) (233) also provides a connection point for accessories associated with the desired use of the attached towel. For example: hand sanitizer dispenser, time piece, stop clock, music player, locker key, other devices to help keep the towel in a clean environment (suction cup), third party accessories, logos.

The magnet FIG. 42 (231) FIG. 43 (231) helps keep the towel clean by allowing it to hang it on magnetically compatible metal objects and away from dirt.

The shape of the Magnetic Connector area FIG. 43 (233) will form the connection point for the various accessories. The accessories will be designed to fit this areas unique shape so that they will stay in place magnetically and mechanically.

FIG. 43 shows the magnet (230) simply stitched to the Tether (240) with the inclusion of a supportive piece (232). There are alternative ways of attaching the magnet to the towel. For example, incasing the magnet into a mechanism FIG. 61-62 (203) that will allow attachment to any towel temporarily, removing it before the washing of the towel. The magnet FIG. 61-62 (203) is incased in a mechanism that has a push button (202) that opens the claws (207) that will grip the towel on the front is a system (204) (205) for the attaching accessories (204) is a slot into which the accessories are slid and (205) is a spring loaded lock that will keep the accessories in place. Accessories can be attached to the back in the same way accessories are attached to the Tethered version (230) (231) (232) (233). In fact the accessories would also be compatible with the Tethered version of the Magnetic Connector. FIGS. 61-62 (206) is part of the accessory attachment platform when attaching accessories to the back. FIG. 61 (206) also provides a textured surface for finger gripping when pushing the button FIG. 61 (202) in order to open the claw FIG. 61 (207). The loop FIG. 61 (201) adds another method to hang the towel.

Logos, company information, team information and other information printed on the magnet that inspires the collection of the magnets. When the towel eventually wears out the magnet can be harvested for use on the refrigerator or other displays or utilitarian purposes.

Tether

The "Tether" is the elongated material by which the "Magnetic Connector" is connected to the perimeter of the towel. Typically made of flexible material allowing it to be quickly tucked into a pocket or waste band and providing other means by which the towel can be kept contaminate free.

The Tether FIG. 42 (240) FIG. 43 (240) FIG. 56 (240) FIG. 57 (240) FIG. 58 (240) FIG. 59 (240) FIG. 60 (240) FIGS. 66-69 (240), (also known as Elongated Member FIG. 68 (241) for example) is a elongated member of material that extends from the Towel FIG. 42 (290) FIG. 43 (290) FIG. 60 (290) at a connection point FIG. 43 (242) and provides a means upon which the towel can be connected to another object without the towel surface coming into direct contact with it, in the event this surface is dirty. The Tether facilitates hanging the Towel in many environments and in different situations due to the mechanisms and devices that can be into the "Tether" FIGS. 43, 56, 57, 58, 60, 66 (244), 67, 68 (243), 69 providing ways that the "Towel" can be kept nearby and in a clean environment until needed.

The "Tether" FIG. 43 (240) (241) can be attached to the Towel FIG. 43 (290) at various points around the perimeter of the towel or within the field of the towel. The Tether can be attached to the Towel by various means, for example, stitching FIG. 43 (242), Velcro, buckles, snaps, buttons, zippers, string, magnets, mechanical gripping devices FIGS. 61-62. The Tether can have one or several methods of hanging the "Towel" with it. The Tether can be of various lengths, widths, circumferences and thicknesses.

More than one Tether may be used in combination to achieve certain advantages. In addition, more accessories attached to the towel to allow one to wear the Towel on ones person in a certain way, to increase the possible ways of hanging the Towel.

If the Tether is not attached to the Towel in a permanent way (a snap) and if the Tether is not desired, that none permanent connector (the snap) can be used to attach accessories directly to the towel.

Carabineer

A carabineer is a mechanism that allows items to be clipped to it for organizational purposes or it could be used to hang an object from another object.

In order to allow the Towel (water absorbent material) more versatility in being able to be hung out of reach of dirty environments and enabling clipping personal items to it for organizational purposes a carabineer FIG. 56,57,58,60(251), 67,69 has been incorporated into the "Tether" of the Towel. FIG. 70 (252) shows a carabineer that has been incorporated directly into the Towel.

Carabineers are curved in design and have an arm FIG. 70 (254) (or some other way of closing the open gap between the two ends of the carabineer) with one end having a flexible joint FIGS. 56 (257), 57 (257), 67 (257), 70 (257) that when closed as shown in FIG. 67 and when open creates a hook as shown in FIG. 57.

The carabineers can be made from various materials: metals, plastics, magnetized material, wood, exotic materials and other non-exotic materials.

A few unique carabineer design elements that allow for its integration with the "Towel" system include a Sandwich construction technique FIGS. 56, 57, 58, 59 and 60 (251). FIG. 59 shows the two halves of the carabineer on the outside (253*a*) and (253*b*) on the outside of the Tether material. FIG. 59 (256) the means by which the sandwiched layers are held together. However, the layers could also be held together by screws, rivets, nuts and bolts, glue.

Traditionally carabineer arms are spring loaded FIG. 67 (254). FIG. 57 (255) shows a carabineer arm that is not spring loaded. It will snap into a fully open position as shown in FIG. 57 allowing the carabineer to be used as a hook or it can be snapped into a fully closed position allowing it to be securely connected to another object for hanging securing other personal items such as keys FIG. 59 (240).

Another unique way of incorporating a carabineer into the towel system is shown in FIGS. 69 (251) and 70 (252). These carabineers are sewn into the fabric.

These carabineers FIGS. 56, 57, 58, 69 and 70 are uniquely designed to be incorporated with materials that are also used in the clothing and luggage industries.

Connection Points (Magnetic Tabs)

A "Connection Point" is a magnet or a magnetically attracted metal tab that are located in strategic locations on the towel. They are either imbedded between layers of material or attached to the towel by other means. When the tab makes contact with the "Magnetic Connector" it creates a loop by which the towel can be hung or dependent upon the size of them could be worn as a garment around the head, neck or waste for example. In addition to connecting the connection points to the magnetic connector they could be connected to each other, magnetic tab to magnetic tab.

"Connection Points" are areas around the perimeter of the Towel where "Magnetic Tabs" are placed FIG. 42 (260*a*) (260*b*) (260*c*) (260*d*). When the Magnetic Tab at FIG. 42 (260*a*) is connected to FIG. 42 (260*b*) a loop in the "Towel" is created. This loop in the Towel (water absorbent material) can be used as a way of securing it around a object until it is needed or allow securing it around the neck or head (as a hat).

The Magnetic Tabs don't necessarily have to be located at the perimeter of the Towel. They can be located within the field of the Towel in order to achieve a desired result, a shape or appropriate sized loop in the towel.

As an alternative to Magnetic Tabs, Velcro, mechanical snaps, buttons and holes, and the use of steel tabs may be appropriate.

The Connection Points may also be used to attach accessories whether by magnet, mechanical snap or so on.

Bottle Cap

This is no ordinary bottle cap but one specifically designed to, more easily, allow a bottle to be inserted thru the Holes in the towel.

The Bottle Cap FIG. 54 would be a replacement for the more traditional styled bottle cap (2105). The new Bottle Cap FIG. 54 is designed with a pointed top FIG. 54 (271) so that it can be more easily, inserted thru all the holes in the towel when it's in its folded position FIG. 65. Some of the hole designs (206) (208) would benefit more from the new Bottle Cap design.

The Bottle Cap FIG. 54 can be constructed from various materials, plastic, wood and metal, organic and non-organic materials.

A Bottle Cap can also be designed with penetrating characteristics in addition to having a loop incorporated. The loop would allow the bottle to be hung as well, with or without the towel on it.

Freezable Gel Packs

"Gel Packs" are appropriately shaped bags that can be frozen and inserted into the towel and used as refreshment to high body temperatures and/or assist in keeping a beverage cool. These Gel Packs may also be microwavable for warm refreshment.

A freezable Gel Pack FIG. 55 is a uniquely designed bag of material that can be frozen and thawed multiple time. They are inserted into the towel. For example, there are pockets designed around the bottle holes shown in (206). The pockets hold the Gel Packs in place by design: overlapping material, zipper, Velcro, snaps.

The Gel Packs are used as an additional refreshment element of the "Towel" and can provide additional cooling to the beverage in the bottle.

The external structure of the Gel Packs can be constructed from a soft silicone material to a hard plastic. Internally they can contain water, synthetic or other chemical compounds.

Alternatively a Gel Pac variant could be used as a heat pack in conjunction with the Towel FIG. 42 (290).

Gel Packs can be located around the Holes FIG. 47 or anywhere within the field of the towel FIG. 42 (290).

Towel (Water Absorbent Material)

The towel is the water absorbent material portion of this product that does the cleaning, wiping and drying. It's typically made from terry cloth but can be made from many other materials tailoring it a specific need.

Other material than can be used but not limited to are sponge, artificial sponge, shammy towel, artificial shammy, leather, artificial. Leather, paper, shop rag cloth material and cotton cloth.

The Towel FIG. 42 (290) is a "terry cloth" material. It works well for absorbing moisture (water, sweat, cleaning agents). This material can be found in most athletic environments.

The Towel portion of this product FIG. 42 (290) can be virtually any water absorbent material: terry cloth, T-shirt cloth, sponge, artificial sponge, shammy cloth, leather, artificial leather, shop rag material, designer cloth, patterned cloth (camouflage), cloth with logos, blanket material.

The size and shape can very dependent upon the need. The size of the associated bottle and how it may be worn, for example, on the body (neck, waste, head, shoulder). It may be ergonomically designed to be worn on the body.

The Towel material could be layered material one side constructed of material that is designed for one task and the other side designed for another task.

The entire Towel could have ventilation hole covering it. This should help with speed in which the "Towel" dries. Possible, only one side of a layered towel would be ventilated with holes (in a gym environment, one side would for the face and one side for the equipment).

The appropriate towel material to be used is dependent upon need and the environment in which it is used. For example, it may be used at gym, washing a car, drying a car, hunting, fishing, various sports, mechanic shop.

Connections of Main Elements and Sub-Elements of Invention

A "Hygienic Towel" consists of a piece of water absorbent material, rectangular in shape FIG. 42 (290). It has two holes (210*a*) (210*b*) appropriately placed so that when the towel is folded in half the two holes will line up creating a clear path thru the (now) two layers of material. To make it more easy to accurately fold the towel two Indicators FIG. 42 (221) (222) have been place at the appropriate locations to indicate where to fold. Once the towel is folded the holes can be placed over an object (water bottle) (224) in order to keep it off dirty surfaces.

It was difficult to find a clean location where a towel could be placed during exercise. Generally the best location was to hang off the piece of equipment being used or on a nearby piece of equipment. The problem with this is that everyone else in the gym has the same idea. Most all these locations have been contaminated with the sweat and dirt from dozens of people at a prior time. The use of the Magnetic Connector FIG. 42, 43 (230) on the Tether FIG. 43 (240) help resolve this dilemma.

The "Tether" FIG. 43 (240) in addition to the "holes for bottle" is a key technological part of the Hygienic Towel system that keeps it out of reach of contaminants. The "Tether" is an elongated member of material that extends from the towel via a connection FIG. 43 (242). Incorporated into the "Tether" are technologies that allow the Tether to be connected to a multitude of objects without subjecting the "Towel" to direct contact. For example: A magnet FIG. 42 (231) FIG. 43 (231), a loop FIG. 43 (243) 66 (243) 68(243), a carabineer FIG. 56 (251) 57 (251) 58 (251) 60 (251) 69 (251), a Hook FIG. 66 (244), a area where upon additional accessories can be attached that will provide even more methods (suction cup, belt clip) by which the towel can be hung FIG. 43. Carabineers FIGS. 57, 59 and 70 are uniquely designed to be incorporated into the Hygienic Towel. From the type of construction FIG. 59 (253) to the way the arm FIG. 57 (255) 70 (254) works, to the way they are connected to the Towel FIG. 56 (251), 67, 69 (251), 70 (252).

The Magnetic Tabs FIG. 42 (260*a*) (260*b*) (260*c*) (260*d*) allow an area of the Towel FIG. 42 (290) to be connected to another area of the "Towel" thus creating a loop that can be used to hang the towel from a object or worn on the body.

Alternative Embodiments of Invention

Alternative Variations of this invention are primarily a mixed use of the "main elements". For example, a Hygienic Towel for one market could simply be the two holes with a fold indicator. In another market it could be a rectangular terry cloth towel with an integrated carabineer FIG. 70. In another market the Hygienic Towel may only have Magnetic Connectors incorporated FIG. 42 (260*a,b,c,d*). An alternative embodiment is a magnet stitched into the towel. Yet an alternative embodiment is an incorporated Gel Pack. Yet an alternative embodiment is a Towel with a Tether and only a magnetized carabineer incorporated into it. In an alternative embodiment the Towel may have a combination of two of the main elements. Magnetic Connectors FIG. 42 (260*a,b,c,d*) and an integrated carabineer FIG. 70. In yet an alternative embodiment the Hygienic towel Holes are designed to work with a specific bottle manufactures product.

Many of the Main Elements of the Hygienic Towel can be applied to other industries or products. For example, the "Fold Location Indicators" can be incorporated into a beach towel, blankets, sheets, clothing. Magnetic Connectors can be incorporated into other clothing and material items to manipulate their shape. The carabineer can be incorporated into clothing, luggage, belts, furniture and car seats.

Alternate variations of the Bottle Cap FIG. 54 can also provide assistance in getting the bottle thru the holes and layers of Towel material. Additionally, the bottle caps could incorporate technology that would allow a person to hand the bottle and Towel simultaneously. For example, molded into the cap could be a carabineer, a hook, a loop (string or plastic). A alternative variation of the traditional terry cloth towel material would be to design ventilation holes into it. The ventilation hole would allow the towel to dry more quickly, never allowing it to get to the point that it is saturated and rendered useless. The holes could be of various sizes and shapes (dime size holes) covering the entire towel in a uniform pattern, resembling a cheese grader or alternatively a honey comb.

In alternative embodiments a specific Bottle is designed to accept the "holes in towel" technology. In other words a bottle and towel combination that only work together FIGS. 52 and 53 for example.

Operation of Preferred Embodiment

The Hygienic Towel was originally conceived as gym or athletic accessory. It would replace the traditional towel and provide the user with more ways of resting the towel with further contamination. Many participants in a athletic event already have with them a container of water. One method for keeping the "Towel" off of dirty surfaces is to use the water bottle as a stand. This is done by folding the towel with the help of the Fold Location Indicators FIG. 42 (221) (222). Lining the holes up so that the neck of the bottle or container can pass thru and rest on the shoulders of the container FIGS. 63-65. This method also allows the user to drink from the bottle without having to remove the towel from it.

There are several ways that more versatility can be provided to the Towel Holes. Not all bottle or containers are designed the same. The holes must be able to adjust to these various shapes to provide the largest market possible to one hole design. If the expandable rubber gasket FIG. 42 (211*a*) (211*b*), FIG. 46 (211) and as shown in FIGS. 63-65 were not used the towel may not stay in place. On one bottle but slide down on another bottle. There are several ways of achieving this versatility.

Much of the exercise equipment in gyms to is constructed of steel and steel cables from the equipment is where many people rest their towels while performing a exercise. The problem with this is that the equipment is rarely cleaned from dust and the residual sweat and grease left behind from the towels of other users. Thus the advantages of the present invention by incorporating a magnet into the Towel FIG. 42 (231), 43 (231).

The Magnetic Connector area FIG. 43 (230-233) provides the means by which the towel can be magnetically adhered to the steel equipment. Being able to do this will allow hanging the towel where it is difficult for dust to collect and where no one else is capable of hanging theirs. This same Magnetic Connector area FIG. 43 (233) provides a platform by which accessories can be attached.

Being able to attach accessories increases the versatility and ways the towel can be hung. There are a lot of mirrors and other smooth surfaces in the gym. A example of an accessory for hanging the towel would be to snap a suction cup onto the Magnetic Connector. An example how the towels general versatility can be increased would by snapping on a clock or hand cleaner (the suction cup could also be permanently attached to the towel).

The connection between the accessories and the Magnetic Connector is magnetic and/or mechanical. Incorporated into the accessory its self is a magnet or a piece of steel that would allow it to connect to the "Towels" magnetic connector area FIG. 43 (233). However, when a magnetic connection alone would not be strong enough or otherwise appropriate, a mechanical one would be used. Taking advantage of the magnets shape and ridged structure and the shape of the Magnet Support FIG. 43 (232) a accessory would be "keyed" (designed to mate up with a unique shape to make a bond) so that it would slip over the Magnetic Connector or would snap on to this area, making a secure connection.

With this version of the Hygienic Towel FIG. 42 the magnet and the accessory connection area FIG. 43 (233) are not connected directly to the Towel its self but attached to a Tether FIG. 43 (240) that extends from the towel. This allows the "Towel" to be hung from or connected to objects that might not be clean and still protect the Towel FIG. 42 (290) from having to come in contact with any of the contaminants on the object.

The Tether, no matter its shape and the material it's made of, is a elongated member FIG. 43 (241) that is connected FIG. 42 (242), 2 (242) to and extends from the "Towel" FIG. 42 (290), 43 (290). It not only has the Magnetic Connector Incorporated FIG. 43 (230) (233) into it but provides an area in which other products and means by which the towel can be protected. FIG. 43 (243) shows a loop incorporated into the end of the "Tether". This loop could be utilized by adding a key ring to it for either keys or hanging it on a nail or peg. FIG. 66 (244) shows how other items such as a hook could be included. Carabineers could also be added FIG. 69 (257). The Tether becomes the "Swiss Army Knife" for the Towel industry. Tethers for specific Towel oriented tasks can be developed. For example, washing a car, repairing a car, hunting & fishing, golfing to biking In many of the potential task oriented towels would be the inclusion of a carabineer. Whether the carabineer is integrated into the Tether FIGS. 56, 57, 58, 60 (251) or integrated into the Towel FIG. 70 (252) they provide a great deal of functionality. Carabineers are a way that items can be connected to the "Towel" so that they can be kept track of and handy in addition to providing another mechanism that can be used to place the "Towel" out of germs reach.

One of the main advantages of the "Hygienic Towel" is to maintain it clean and handy until needed. Yet another mechanism to achieving this advantage is with the use of Connection Points (magnetic tabs) FIG. 42 (260*a,b,c,d*). The "Tabs" can be connected to one another creating a loop in the towel, allowing it to hang on an object or be worn on a person. When running in cold weather it might be nice to have a towel securely wrapped around a neck for warmth (in addition to incorporated hot Gel Pack). If it began to rain during exercising, for example, while running, the adjustments could be made using the tabs to secure the towel on a head.

The same Gel Pack FIG. 55 mentioned above can also be a frozen and inserted into the pockets incorporated into the towel. In a Hot Yoga environment, in addition to the towel, the cool Gel Packs will provide moments of refreshment. Alternatively it may be used after return home from a hard work out or a hard day of work to enjoy this refreshment.

It is very like that the Hygienic Towel for sport purposes will be sold with a corresponding bottle. A bottle that's top is specifically designed to go thru the holes FIG. 42 (210) of the corresponding towel. There will be various styles of hole. If a Hygienic Towel is purchased separately, it will not be impossible to use a large variety and sizes of bottles but separate Bottle Caps FIG. 54 will be available for purchase that will make it easier to put the towel over the bottle neck.

This is a Towel to the 3rd power (towel3) and possibly the 4th power.

Referring to FIGS. 72-75, in some embodiments a towel 10, such as towel incorporating some or all of the features disclosed herein may include one or more features to enable folding and unfolding of the towel 10. For example, opposing edges of the towel may have notches 246*a*, 246*b* formed therein, such as semicircular notches or notches of some other shape. As is apparent in FIG. 72, the notches 246*a*, 246*b* are offset from one another. One side of the towel may have markers 248*a*, 248*b* printed thereon or secured thereto adjacent the notches 246*a*, 246*b*. The opposite side may have markers 250*a*, 250*b* printed thereon or secured thereto adjacent the notches 246*a*, 246*b*. The markers 250*a*, 250*b* may have a different color form the markers 248*a*, 248*b* or be otherwise distinguishable due to shape, pattern, texture, size, or some other perceptible attribute.

As shown in FIG. 74, when the towel 10 is folded in half, marker 250*b* is exposed through notch 246*a* and marker 248 is also visible. As shown in FIG. 74, on an opposite side of the folded towel 10, marker 25*a* is exposed through notch 246*b* and marker 248*b* is exposed. In this manner it is easy for a user to know where to grip in order to unfold the towel: grasp the marker 250*a* on one side and the marker 250*b* on the other side and separate the halves of the towel.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

INDEX OF ELEMENTS

10: Towel Material
11: Stitching to prevent fraying of terry cloth or woven cloth.
12: Terry Cloth/microfiber
13: Nonwoven
14: Laminated Nonwoven Material
20: Hooks Or Loops (means By Which To Hang The Towel)
21: Imbedded Rubber Coated Flexible Wire
22: Attached Rubber Coated Wire
23: Suction Cup
24: Imbedded Rope
25: Incorporation of Animated Objects
26: Incorporation of Corporate Logos
27: Imbedded Elastic Cord
28: Rubber Coating
29: Rubber Flang to be stitched to towel material
30: Holes in Towels
31: Holes for Bottle
32: Towel Locking Holes
33: Holes for Hanging Towel
34: Holes for Wicking
35: Holes for Contouring the Towel
40: Magnet
41: Magnet Incorporated Into Design
50: Fold Indicators
51: Pinched and Stitched Indicators
52: Raised Surface Indicators
60: Bottle Gripping
61: Rubber Attached to Towel
62: Augmenting the Towel
63: Placement of Holes for Bottle

70: Cut Corner
71: Location for Attaching Rope Loops
72: Location for Attaching Logos
73: Location for Attaching Magnets
74: Location for Attaching Imbedded Wire
75: Cut Corner Look Achieved by Folding Corner
80: Towel Shapes
81: Shaped for Better Bottle Gripping
82: Shaped to get more towel on the Bottle without touching bottle resting surface.
83: Shaped to have Flying Characteristics.
84: Shaped to be Cape Like.
90: Laminated Nonwoven Material
91: Material #a
92: Material #b
100: Perforations
101: Perforations for sizing a towel to fit a specific bottle height.
102: Perforations for holes for bottle or any other of the sports towel characteristics.

The embodiments of the invention in which an exclusive property or privilege is claimed are defined as follows:

1. An apparatus comprising:
a sheet of absorbent material having a plurality of apertures and a plurality of slits, wherein
each of the plurality of apertures and each of the plurality of slits are positioned within the sheet such that when the sheet is folded such that each of the plurality of apertures is aligned with each of the other plurality of apertures, an extent of the folded sheet outward from the apertures is less than an extent of the sheet when unfolded and each of the plurality of slits is aligned with each of the other plurality of slits, and
each of the plurality of apertures is offset from a center of the folded sheet and equidistance from a first edge and a second edge of the fold sheet, wherein the first edge and the second edge are opposing edges.

2. The apparatus of claim 1, wherein the sheet has at least an aperture that is separate from the plurality of apertures and positioned proximate a corner of the sheet.

3. The apparatus of claim 1, wherein the sheet is foldable according to a folding pattern having equally sized panels, each panel having at least one aperture of the plurality of apertures that is positioned substantially at a center thereof.

4. The apparatus of claim 3, further comprising, one or more fold indicators formed on the sheet, wherein the one or more fold indicators are positioned to indicate where the sheet is to be folded such that each of the plurality of apertures is aligned with each of the other plurality of apertures and correspond to the folding pattern.

5. The apparatus of claim 4, wherein the fold indicators comprise stitching in the sheet.

6. The apparatus of claim 1, wherein the sheet has non-uniform composition across an extent thereof.

7. An apparatus comprising:
a sheet of absorbent material having a plurality of apertures and a plurality of slits, wherein each of the plurality of apertures and each of the plurality of slits are positioned within the sheet such that when the sheet is folded such that each of the plurality of apertures is aligned with each of the other plurality of apertures, an extent of the folded sheet outward from the apertures is less than an extent of the sheet when unfolded and each of the plurality of slits is aligned with each of the other plurality of slits; and
a plurality of gripping elements secured around at least one of the apertures of the plurality of apertures.

8. The apparatus of claim 7, wherein the sheet has at least an aperture that is separate from the plurality of apertures and positioned proximate a corner of the sheet.

9. The apparatus of claim 7, wherein the sheet is foldable according to a folding pattern having equally sized panels, each panel having at least one aperture of the plurality of apertures that is positioned substantially at a center thereof.

10. The apparatus of claim 9, further comprising one or more fold indicators formed on the sheet, wherein the one or more fold indicators are positioned to indicate where the sheet is to be folded such that each of the plurality of apertures is aligned with each of the other plurality of apertures and correspond to the folding pattern.

11. The apparatus of claim 10, wherein the fold indicators comprise stitching in the sheet.

12. The apparatus of claim 7, wherein the sheet has non-uniform composition across an extent thereof.

13. An apparatus comprising:
a sheet of absorbent material having a plurality of apertures and a plurality of slits, wherein
each of the plurality of apertures and each of the plurality of slits are positioned within the sheet such that when the sheet is folded such that each of the plurality of apertures is aligned with each of the other plurality of apertures, an extent of the folded sheet outward from the apertures is less than an extent of the sheet when unfolded and each of the plurality of slits is aligned with each of the other plurality of slits, and
at least one of the plurality of slits is sized to receive a user's hand and intersects an edge of the sheet to form a discontinuity in the edge.

14. The apparatus of claim 13, wherein the sheet has at least an aperture that is separate from the plurality of apertures and positioned proximate a corner of the sheet.

15. The apparatus of claim 13, wherein the sheet is foldable according to a folding pattern having equally sized panels, each panel having at least one aperture of the plurality of apertures that is positioned substantially at a center thereof.

16. The apparatus of claim 15, further comprising one or more fold indicators formed on the sheet, wherein the one or more fold indicators are positioned to indicate where the sheet is to be folded such that each of the plurality of apertures is aligned with each of the other plurality of apertures and correspond to the folding pattern.

17. The apparatus of claim 16, wherein the fold indicators comprise stitching in the sheet.

18. The apparatus of claim 13, wherein the sheet has non-uniform composition across an extent thereof.

19. An apparatus comprising:
a sheet of absorbent material having a plurality of apertures and a plurality of slits, wherein
each of the plurality of apertures and each of the plurality of slits are positioned within the sheet such that when the sheet is folded such that each of the plurality of apertures is aligned with each of the other plurality of apertures, an extent of the folded sheet outward from the apertures is less than an extent of the sheet when unfolded and each of the plurality of slits is aligned with each of the other plurality of slits, and
the sheet comprises a first outer layer, a second outer layer, and an inner layer, the first and the second outer layers being more effective to wick moisture than the inner layer.

20. The apparatus of claim 19, wherein the sheet has at least an aperture that is separate from the plurality of apertures and positioned proximate a corner of the sheet.

21. The apparatus of claim 19, wherein the sheet is foldable according to a folding pattern having equally sized panels, each panel having at least one aperture of the plurality of apertures that is positioned substantially at a center thereof.

22. The apparatus of claim 21, further comprising one or more fold indicators formed on the sheet, wherein the one or more fold indicators are positioned to indicate where the sheet is to be folded such that each of the plurality of apertures is aligned with each of the other plurality of apertures and correspond to the folding pattern.

23. The apparatus of claim 22, wherein the fold indicators comprise stitching in the sheet.

24. The apparatus of claim 19, wherein the sheet has non-uniform composition across an extent thereof.

25. An apparatus comprising:

a sheet of absorbent material having a plurality of apertures and a plurality of slits, wherein each of the plurality of apertures and each of the plurality of slits are positioned within the sheet such that when the sheet is folded such that each of the plurality of apertures is aligned with each of the other plurality of apertures, an extent of the folded sheet outward from the apertures is less than an extent of the sheet when unfolded and each of the plurality of slits is aligned with each of the other plurality of slits, at least one of a shape, a size, or an elasticity of a perimeter of each of the plurality of apertures define a locking mechanism such that the sheet is secured on a bottle when a neck of the bottle is received by each of the plurality of apertures, and the shape of each aperture of the plurality of apertures defines an opening having a primary diameter portion and a notch protruding from the primary diameter portion, wherein the shape of each of the plurality of apertures is keyed to mate with a shape of a bottle and secure the sheet on the bottle when a neck of the bottle is received by each of the plurality of apertures and the sheet is twisted such that the notches are dis-aligned with the shape of the bottle.

26. The apparatus of claim 25, wherein the sheet has at least an aperture that is separate from the plurality of apertures and positioned proximate a corner of the sheet.

27. The apparatus of claim 25, wherein the sheet is foldable according to a folding pattern having equally sized panels, each panel having at least one aperture of the plurality of apertures that is positioned substantially at a center thereof.

28. The apparatus of claim 27, further comprising one or more fold indicators formed on the sheet, wherein the one or more fold indicators are positioned to indicate where the sheet is to be folded such that each of the plurality of apertures is aligned with each of the other plurality of apertures and correspond to the folding pattern.

29. The apparatus of claim 28, wherein the fold indicators comprise stitching in the sheet.

30. The apparatus of claim 25, wherein the sheet has non-uniform composition across an extent thereof.

* * * * *